US008544238B2

(12) United States Patent
Larouche et al.

(10) Patent No.: US 8,544,238 B2
(45) Date of Patent: Oct. 1, 2013

(54) CONSTRUCTION SYSTEM AND METHOD FOR MULTI-FLOOR BUILDINGS

(75) Inventors: Joey Larouche, Mont-St-Hilaire (CA); Gilles Larouche, Mont-St-Hilaire (CA); Justin Larouche, Mont-St-Hilaire (CA)

(73) Assignee: 3L-Innogenie Inc., Mont-St-Hilaire (CA)

( * ) Notice: Subject to any disclaimer, the term of this patent is extended or adjusted under 35 U.S.C. 154(b) by 0 days.

(21) Appl. No.: 13/147,897

(22) PCT Filed: Feb. 5, 2010

(86) PCT No.: PCT/CA2010/000161

§ 371 (c)(1), (2), (4) Date: Aug. 4, 2011

(87) PCT Pub. No.: WO2010/088771

PCT Pub. Date: Aug. 12, 2010

(65) Prior Publication Data

US 2011/0289862 A1 Dec. 1, 2011

Related U.S. Application Data

(60) Provisional application No. 61/150,813, filed on Feb. 9, 2009.

(51) Int. Cl.
*E04G 21/14* (2006.01)
*E04B 1/00* (2006.01)

(52) U.S. Cl.
USPC ..... 52/745.2; 52/125.1; 52/122.1; 52/123.1

(58) Field of Classification Search
USPC ..... 52/122.1, 125.1, 123.1, 125.2, 745.2, 52/236.3, 745.13
See application file for complete search history.

(56) References Cited

U.S. PATENT DOCUMENTS

| | | | | |
|---|---|---|---|---|
| 2,160,446 | A | 5/1939 | Stalfort | |
| 3,036,816 | A * | 5/1962 | Stubbs et al. | 254/89 R |
| 3,579,935 | A * | 5/1971 | Regan et al. | 52/125.1 |
| 3,692,446 | A * | 9/1972 | Vanderklaauw | 425/63 |

(Continued)

FOREIGN PATENT DOCUMENTS

CA 2632884 6/2007

OTHER PUBLICATIONS

PCT—International Search Report.

*Primary Examiner* — Brian Glessner
*Assistant Examiner* — Beth Stephan
(74) *Attorney, Agent, or Firm* — Norton Rose Fulbright Canada LLP

(57) ABSTRACT

A multi-floor building construction system for progressively constructing floors on load-bearing means of a foundation as the occupational need to do so arises and while sub-floors can be occupied. A permanent roof structure is displaceably supported over an uppermost floor of at least an upper one of one or more occupational floor spaces. Extensible load support means is secured in the roof structure until the completion of the mufti-floor building. The extensible load support means rests upon the uppermost floor to support the total load of the permanent roof structure. The extensible load support means is extendible downwardly to push against the uppermost floor to raise the permanent roof structure. Adjustable hoisting means is secured inside the permanent roof structure for lifting floor sub-assemblies fabricated in the construction zone using the extensible load support means while simultaneously raising the permanent roof structure.

34 Claims, 30 Drawing Sheets

(56) References Cited

U.S. PATENT DOCUMENTS

| | | | | | |
|---|---|---|---|---|---|
| 3,726,053 | A | * | 4/1973 | Filipek et al. | 52/123.1 |
| 3,828,513 | A | * | 8/1974 | Vanderklaauw | 52/745.04 |
| 3,974,618 | A | * | 8/1976 | Cortina | 52/745.14 |
| 4,301,630 | A | * | 11/1981 | Burkland | 52/125.1 |
| 4,691,485 | A | * | 9/1987 | Nagy et al. | 52/125.1 |
| 4,832,315 | A | * | 5/1989 | Vanderklaauw | 254/89 H |
| 4,980,999 | A | * | 1/1991 | Terenzoni | 52/125.6 |
| 5,088,263 | A | * | 2/1992 | Horii et al. | 52/745.13 |
| 5,327,690 | A | * | 7/1994 | Saito | 52/29 |
| 5,371,993 | A | * | 12/1994 | Saito | 52/745.1 |
| 5,417,018 | A | * | 5/1995 | Matsumoto et al. | 52/123.1 |
| 5,528,877 | A | * | 6/1996 | Franklin | 52/745.13 |
| 5,575,591 | A | * | 11/1996 | Vanderklaauw | 405/230 |
| 5,839,239 | A | * | 11/1998 | Jang | 52/123.1 |
| 5,970,680 | A | * | 10/1999 | Powers | 52/745.05 |
| 6,082,058 | A | * | 7/2000 | Deng | 52/125.1 |
| 6,260,311 | B1 | * | 7/2001 | Vladikovic | 52/122.1 |
| 6,379,085 | B1 | * | 4/2002 | Vanderklaauw | 405/230 |
| 7,818,942 | B2 | * | 10/2010 | Nakamitsu et al. | 52/745.01 |
| 2003/0136062 | A1 | * | 7/2003 | Gunthardt | 52/120 |

* cited by examiner

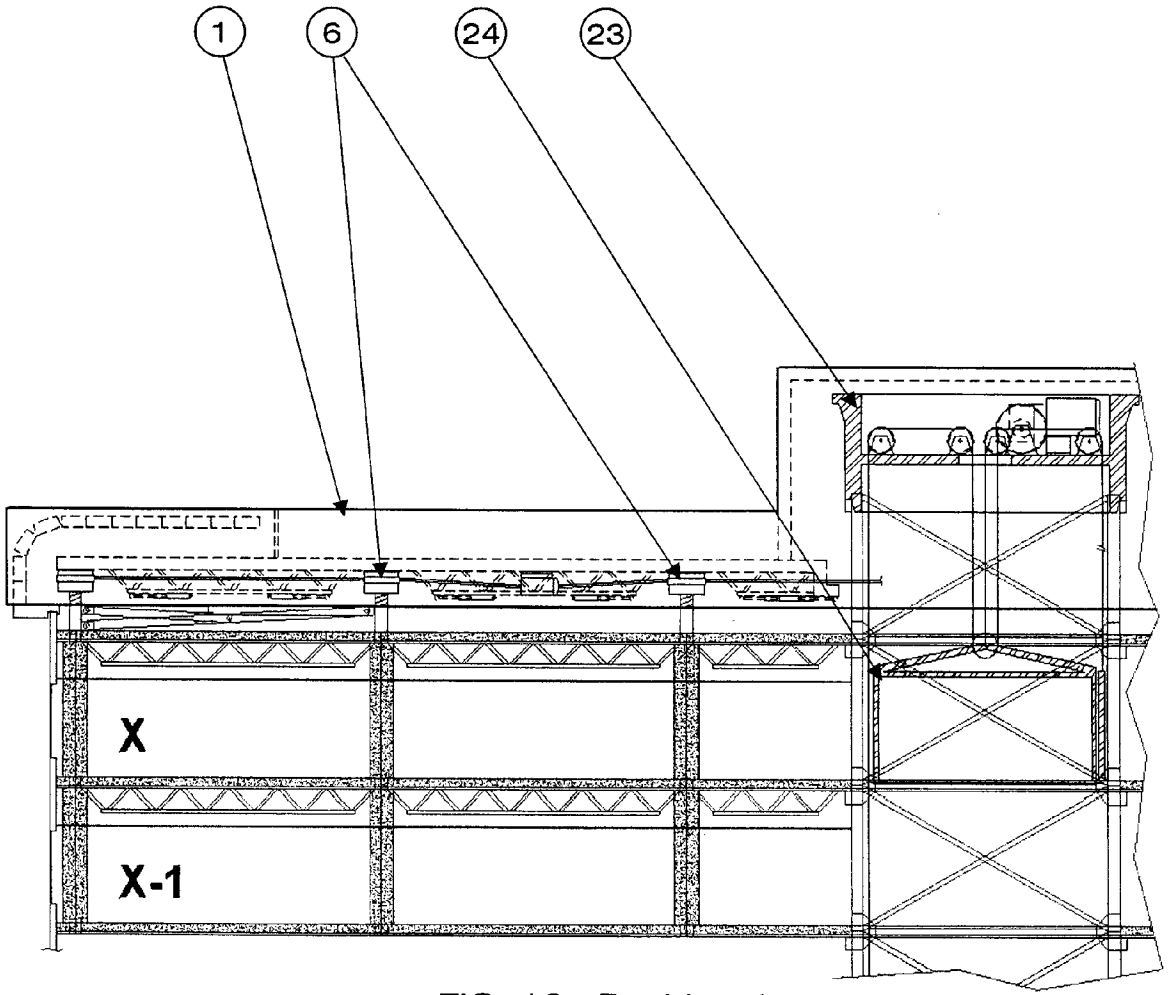
FIG. 18 : Position A

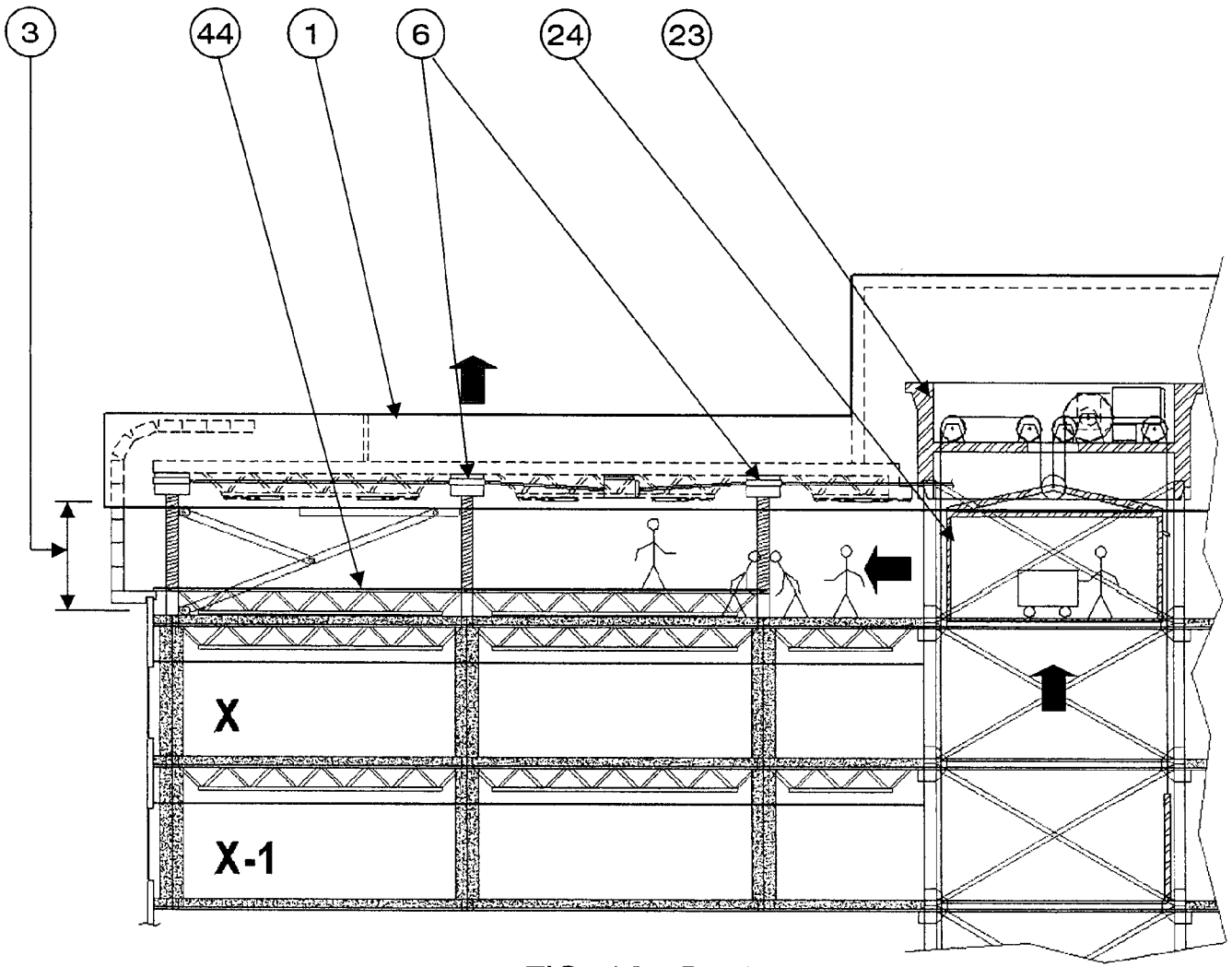
FIG. 19 : Position B

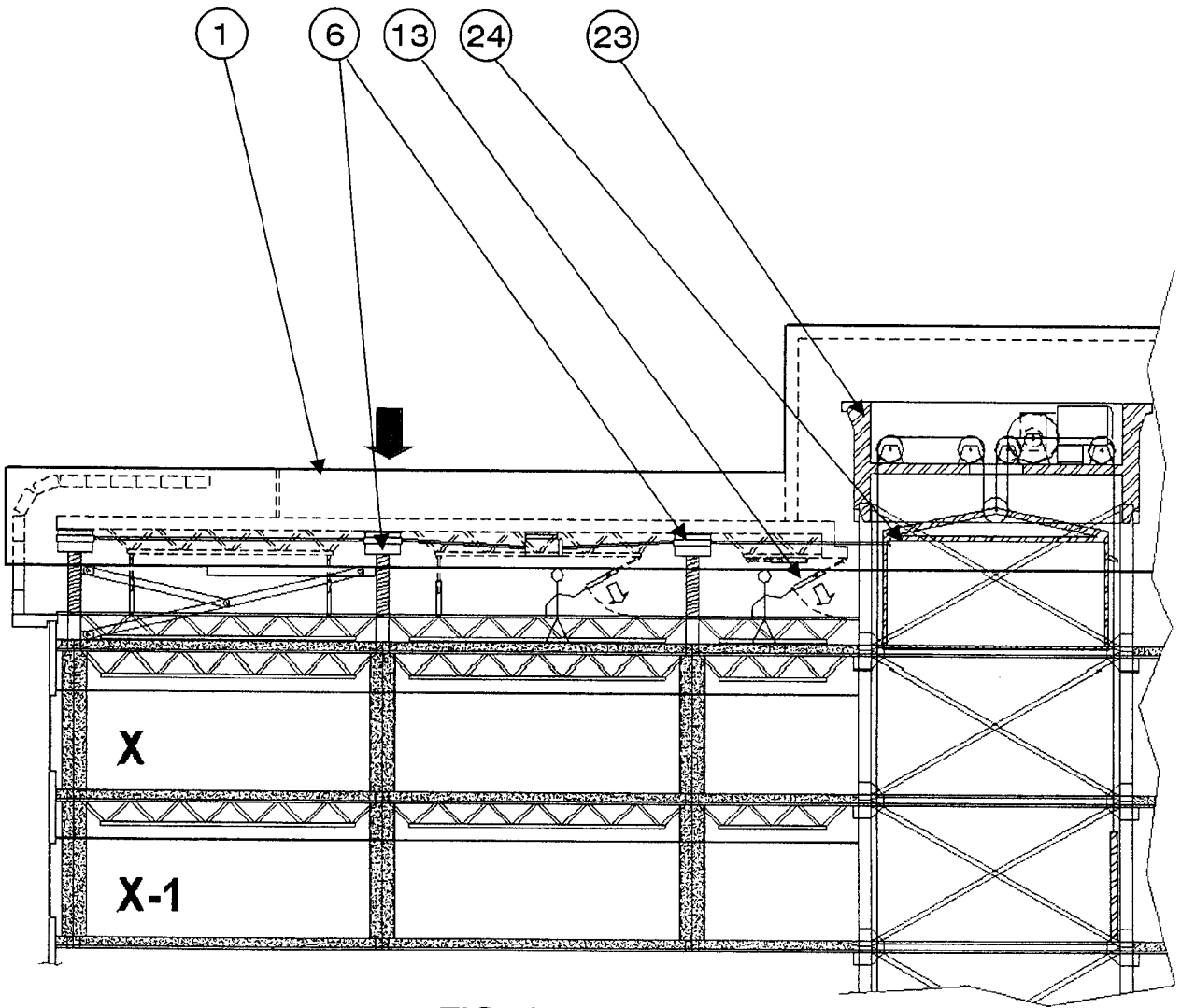
FIG. 20 : Position C

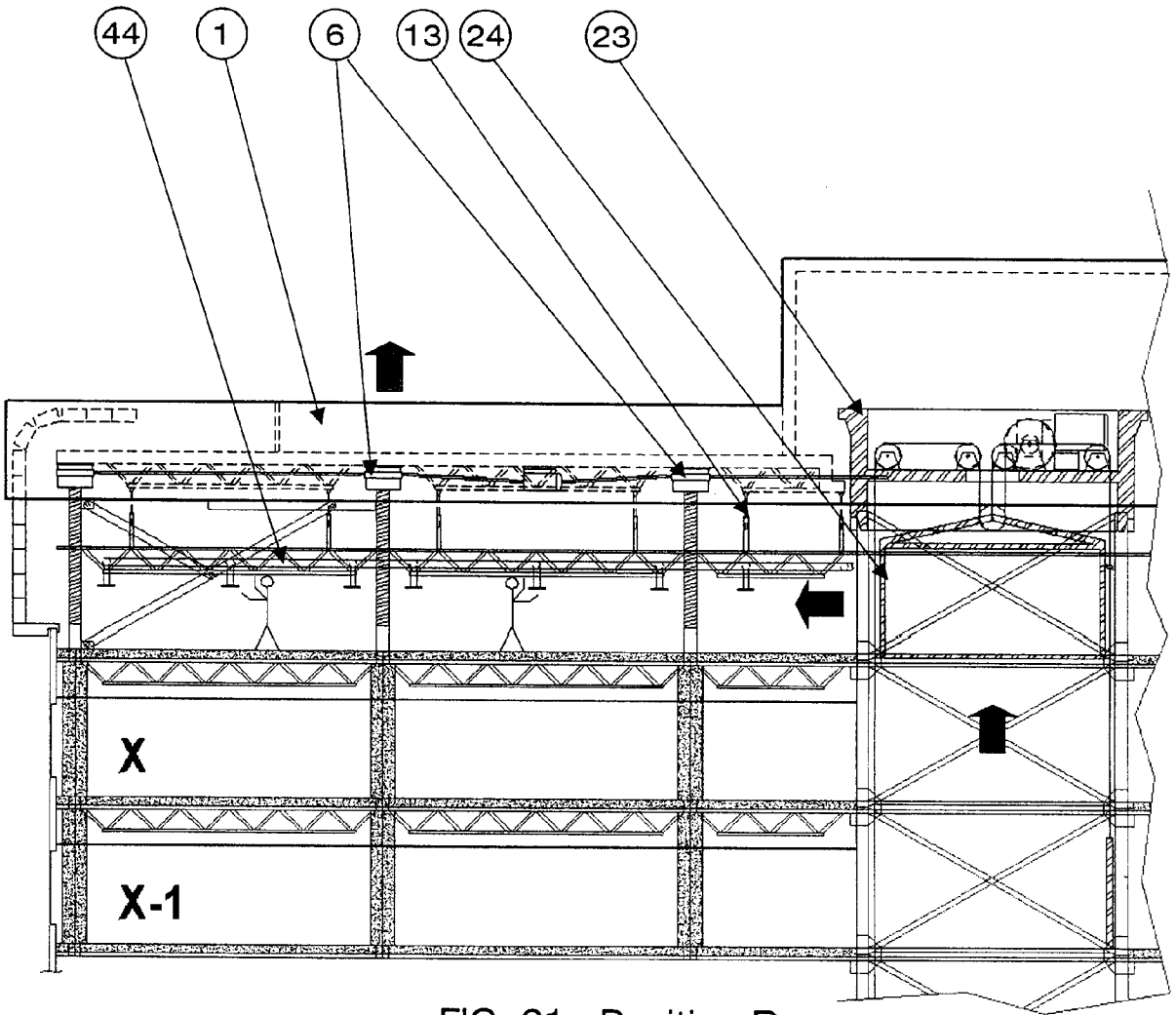
FIG. 21 : Position D

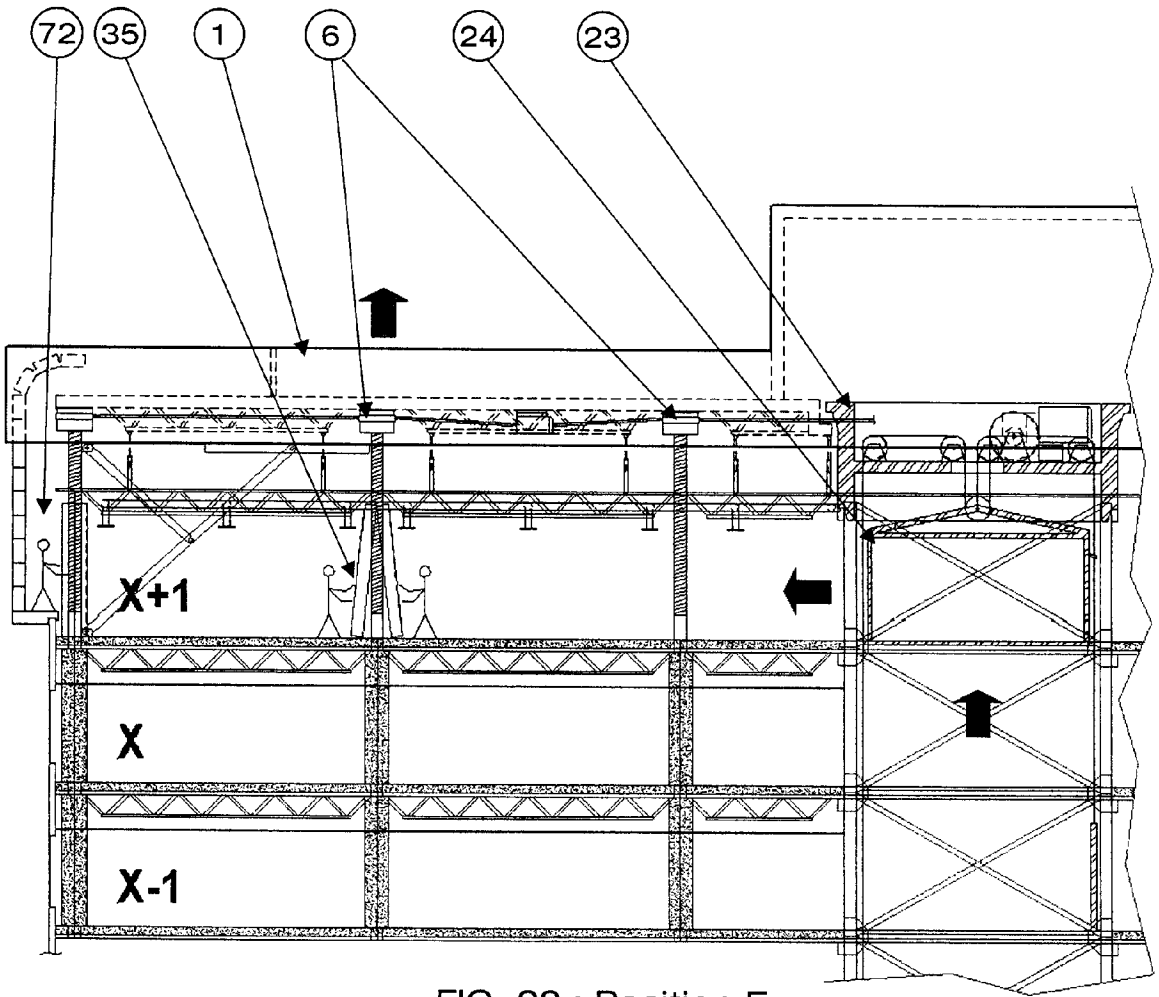
FIG. 22 : Position E

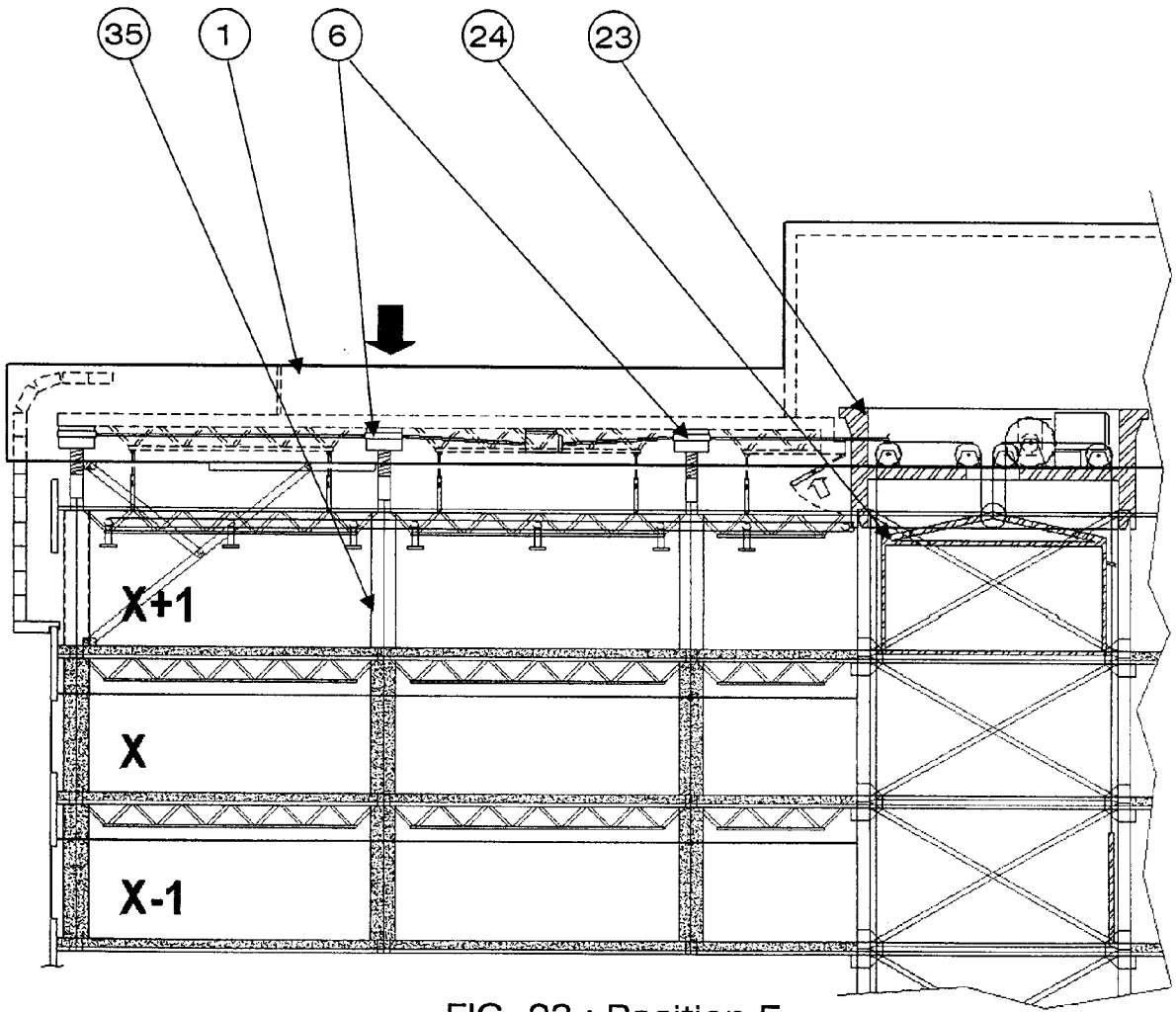
FIG. 23 : Position F

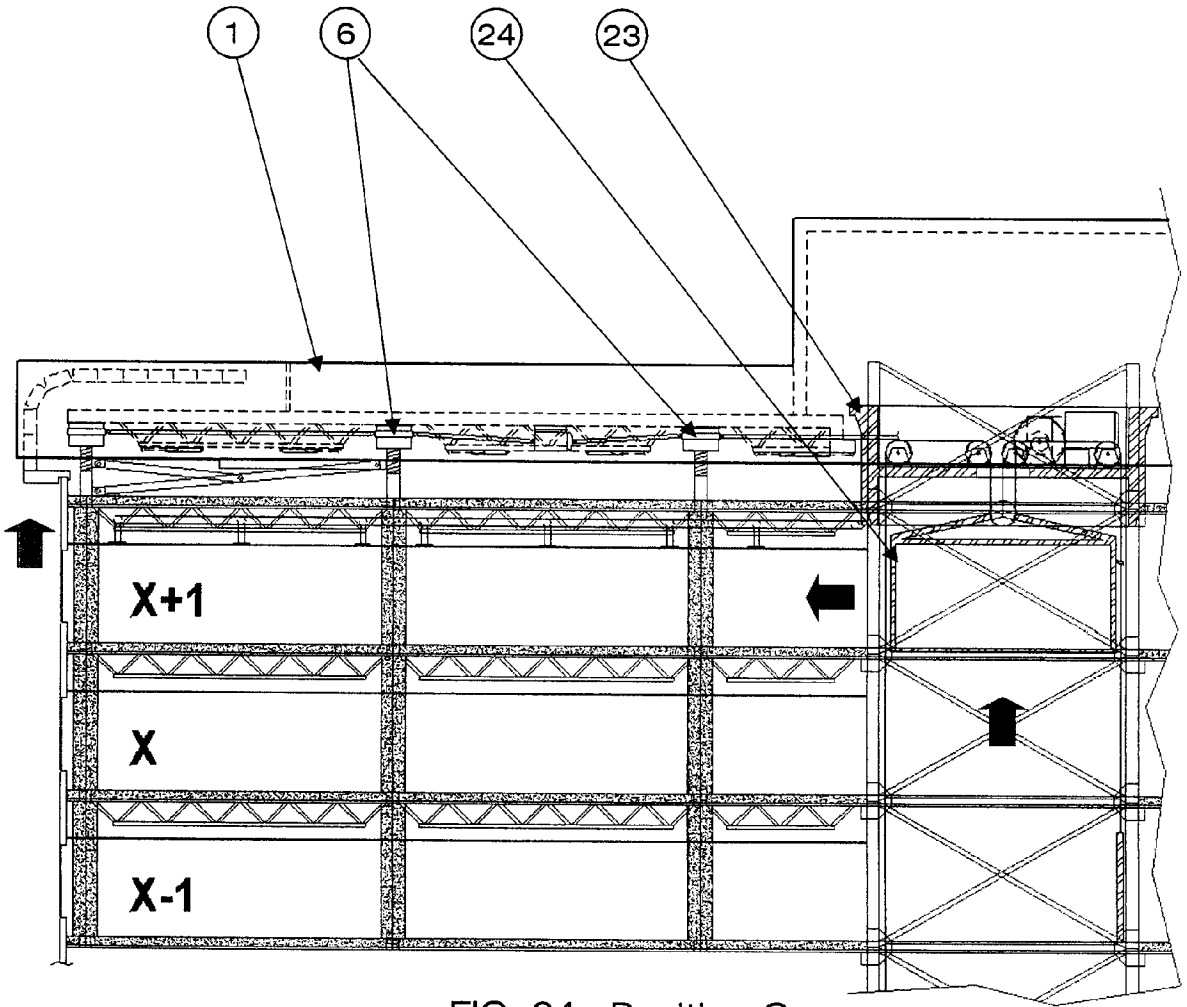
FIG. 24 : Position G

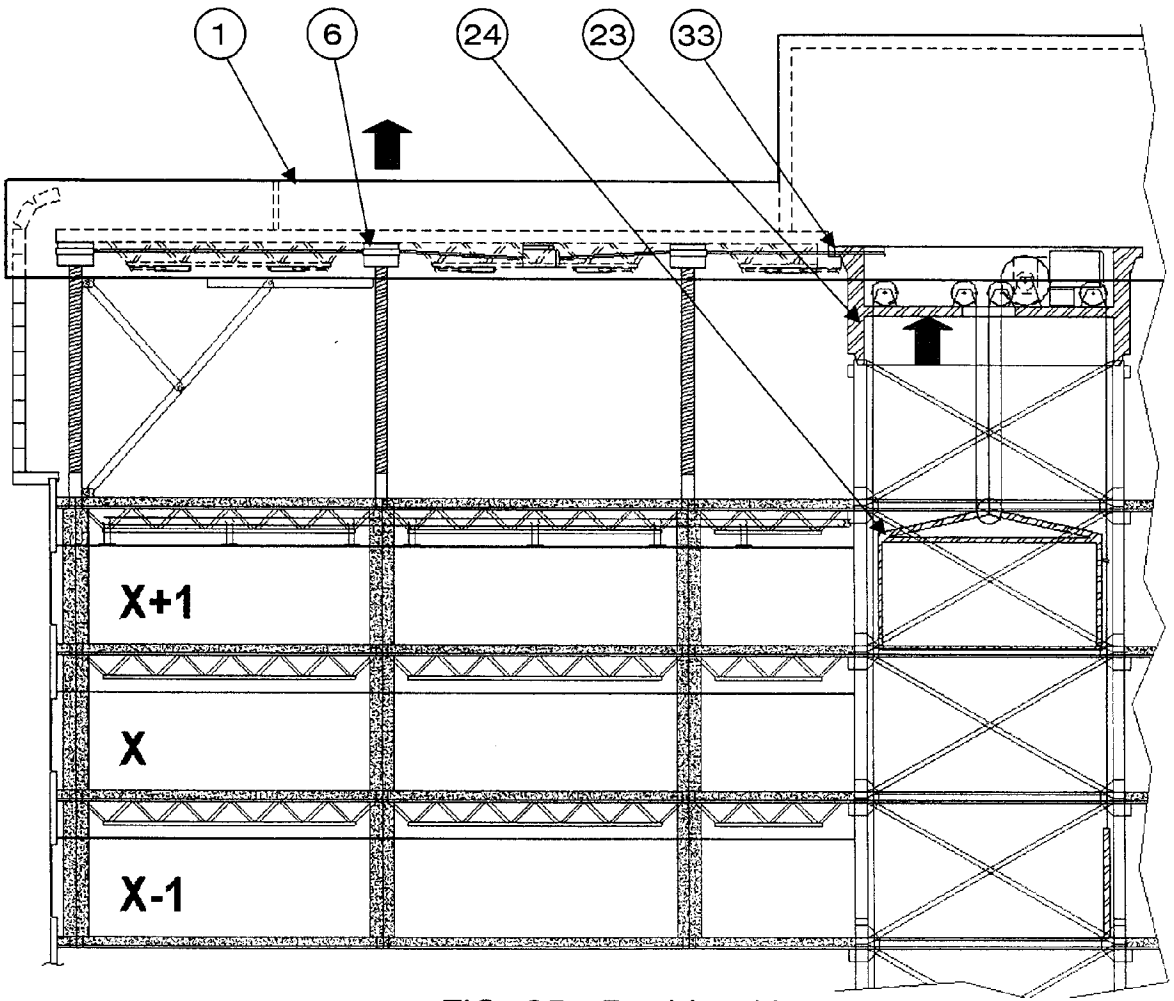
FIG. 25 : Position H

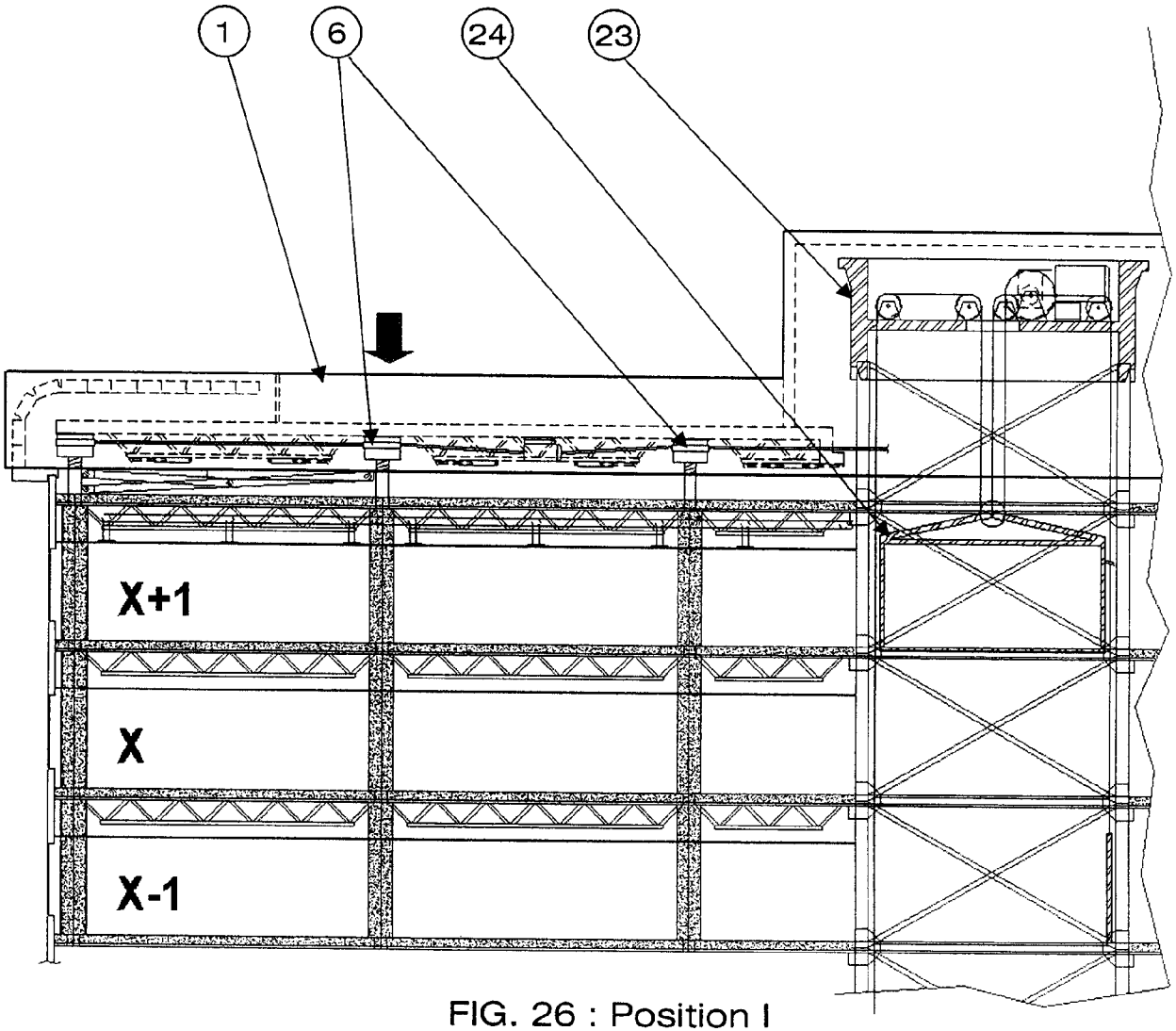
FIG. 26 : Position I

CONSTRUCTION SYSTEM AND METHOD FOR MULTI-FLOOR BUILDINGS

CROSS-REFERENCE TO RELATED APPLICATION

The present application is a National Phase of International application No. PCT/CA2010/000161, filed Feb. 5, 2010, which claims priority on U.S. provisional patent application no. 61/150,813 filed on Feb. 9, 2009.

TECHNICAL FIELD

The present invention generally relates to the construction methods for multi-floor buildings and specifically to a multi-floor building construction system and method for progressively constructing floors on a foundation as the occupational need to do so arises while allowing previously constructed floors to be occupied.

BACKGROUND ART

Construction projects of multi-floor and tall buildings are becoming more and more important in terms of number of floors, number of employees involved in their construction, the financing requirements and the impact such projects have on the urban life of the project neighborhood.

Many construction projects are completed in regions where weather conditions have a direct impact on workers productivity and security. The contractors also need to respect codes and standards for environment, safety and ergonomics that apply with increasing rigor. The traditional construction method poses real challenges when it comes to vertical transportation of the materials and workers. Working high on open structures, using tower cranes and boom lifts handling materials up in the air represent a major source of incidents, injuries and even death of employees on a regular basis. Tower cranes also represent significant cost charges for taller buildings. Furthermore, the control of an open work environment is complex and difficult to maintain.

A fair amount of construction projects for multi-floor buildings are held by a lack of sufficient financing or a lower leasing ratio than expected. Those constraints are even more important and regular during difficult economical times where the initial leasing ratio target often increases in order to reduce the risk associated with long term financing. Other projects highly desirable on a long term time scale are impossible to realize with the conventional method because of the impact they would have in high density urban area or other specific area very sensible to the impacts of such projects. The current construction methods are not flexible and very sensitive to changes and unpredictable situations that may arise during the project, sometimes affecting very badly the project profitability. The owners and contractors have no flexibility on schedule and project scale when it comes to adapting to a sudden specific situation. So far, construction projects methods only allowed occupancy after substantial completion of the construction, which delays significantly the revenues and affects the project financial balance. The investments are so important for taller buildings that only a very small group of selected contractors and owners can consider such projects. Even with the best planning, large construction projects still represent important risks for those responsible for their completion.

SUMMARY OF THE INVENTION

The system of the present invention includes a permanent roof structure equipped with multiple means for vertical displacement, such as extensible load support means, secured in said permanent roof structure. The multiple extensible load support means are synchronized and controlled to allow the permanent roof structure to be lifted in order to create a secure and protected construction zone, under the permanent roof structure, for at least one additional occupational floor to be built. The permanent roof structure can be lifted to create new construction zone as lower floors are completed and occupational need to do so arises. In order to provide the construction zone with the required materials, components, tools and workers, one or multiple means of vertical transportation and material handling, such as dedicated high capacity freight elevators are also part of the system. Such material handling means will allow construction to occur without affecting occupants of the building, its surroundings and its neighborhood and will avoid public space occupancy that typically occurs during conventional building construction. Vertical transportation of occupants is achieved with dedicated extensible elevators having the suspension and electric cables accumulated and available for future extension.

To secure the construction zone, the permanent roof structure is equipped with a wall enclosure system. The wall enclosure shields the construction zone on its entire perimeter, eliminating losses due to inclement weather conditions and protecting workers and neighborhood from the risks associated with the conventional method of construction. The disclosed construction system also incorporates adaptations to the elevators, and the mechanical and electrical systems of the building to allow their extensions when adding occupational floors without affecting services to the completed occupational floors below the construction area and to provide continuous services to the permanent roof structure and to workers in the construction zone.

The permanent roof structure is also equipped with adjustable hoisting means, such as manually installed hooks, that will allow workers to hook and locate the construction material and components sub-assembly they are completing at the most ergonomic and comfortable height, variable for any tasks of the assembly. For example, the sub-assembly of all the horizontally oriented conduits and components for plumbing, electrical, fire protection and other systems are completed at optimal ergonomic and productive heights. When electrical and mechanical horizontal conduits are assembled, the extensible load support means lift the permanent roof structure and the hooked construction sub-assembly to allow the installation of a temporary or permanent load supporting means for the construction sub-assembly. This allows to pour concrete, when applicable, fabricate the interior divisions, install vertically oriented construction materials and connect the resulting vertical sub-assembly to the horizontal construction sub-assembly above which will lead to the completion of the construction of the new occupational floor. For concrete constructions, the extensible load support means are retracted back in the permanent roof structure before the concrete is poured. The construction sub-assembly can be supported by temporary load support means that are also used as concrete forms to pour concrete. The temporary load supporting forms are equipped with a top interface that is capable of supporting the construction sub-assembly and provide the next attachment points for the base of the extensible load support means. The extensible load support means retracts inside the temporary load supporting forms and are re-attached on the top portion of the temporary load supporting forms using interface elements. An alternate location of the extensible load support means could be offset from the permanent load supporting means of the building when the building structure is designed accordingly.

The system and method of the present invention provides several features and advantages such as providing more flexibility in the construction project management by offering the possibility to add floors as the occupational need to do so arises, within a given pre-determined number of floors range. It also reduces the initial financing requirement by allowing to lease the first lower floors as soon as they are completed without waiting for the complete building to be constructed and therefore preempt revenues much sooner in the project cash flow.

The present invention also increases flexibility in the project management by allowing more work to be done in factory and by offering the possibility to sub-divide the work schedule into smaller work lots and therefore increase the competitiveness of subcontractors offer. It also facilitates the human resources management for contractors by leveling the work load, reducing the amount of interruptions, reducing overtime and giving the possibility to work on multiple smaller projects simultaneously instead of only a few very large projects and be impacted by their variable schedules.

The invention further improves health and safety conditions and the quality of the craftsmanship by improving the work environment, independent from outside weather conditions, by providing much better ergonomics at work and by reducing the use of high risk equipment such as tower cranes, boom lifts, ladders and scaffoldings.

The invention also increases the productivity by allowing to complete the structural work of a new floor while standing on the floor and then locate the construction sub-assembly at the desired height for best ergonomic position during the balance of the assembly work.

The invention further reduces or eliminate inconveniences that large urban construction sites impose by concentrating and optimizing trucks unloading, material storage and material vertical transportation inside the building or a controlled area, and therefore allowing to restore building neighborhood much more quicker than for projects with conventional methods and to reduce charges for public occupancy. It also increases post-construction building efficiency for renovation projects, client relocation, or any other situation in the building life that requires efficient vertical material handling and isolation of construction area.

According to a broad aspect of the present invention there is provided a multi-floor building construction system for progressively constructing floors on load-bearing means of a foundation as the occupational need to do so arises and while sub-floors can be occupied. The system comprises a permanent roof structure of any desired architectural shape displaceably supported over an uppermost floor of at least an upper one of one or more occupational first floor space constructed over the foundation. Extensible load support means is secured in the roof structure and adapted to rest upon and push against the uppermost floor to support a total load of the permanent roof structure. Means is provided to operate the extensible load support means in synchronization to elevate the permanent roof structure to create a construction zone over the uppermost floor of the building structure where an occupational floor space is to be constructed under the permanent roof structure with the permanent roof structure held elevated from the uppermost floor by the extensible load support means. Means is also provided to transport construction materials within dedicated and enclosed spaces isolated from the occupational floor spaces. Occupant services providing means is adapted to the further occupational floor space and integrated with existing occupational floor spaces.

According to a further broad aspect of the present invention there is provided a method of constructing a multi-floor building progressively, floor-by-floor, by adding floors above an uppermost occupational space as the need to do so arises and while sub-floors can be occupied. The method comprises the steps of providing a load-bearing floor with load-bearing means. A permanent roof structure is constructed over the load-bearing floor. Extensible load support means is secured in the permanent roof structure and aligned to rest upon or in close proximity to at least some of the load-bearing means to support a total load of the permanent roof structure. The extensible load support means is adapted to be operated in synchronization. The permanent roof structure is lifted a predetermined distance above an upper occupational floor space to create a construction zone above the occupational floor space to construct one or more additional occupational floor spaces as the need to do so arises. Material is provided to the construction zone with at least one vertical transportation means displaceable in a dedicated enclosure isolated from the occupational floor space. Occupant services are provided to the one or more additional occupational floor spaces and integrated with existing occupational floor spaces.

The method further comprises at least one extensible occupants elevator being extended as the demand to do so arises using the extensible load support means or another lifting means to locate the mechanisms of the elevator and release suspension and electric cables to accommodate the new extended stroke or travel.

According to a still further broad aspect of the present invention there is provided a business method of constructing a multi-floor building comprising constructing a permanent roof structure over a foundation and elevating the permanent roof structure a predetermined distance over an occupational floor space thereunder as the occupational need to do so arises upon the pre-sale of at least portions of a further occupational floor space to obtain the financing to construct the further occupational floor space. The permanent roof structure remaining on the multi-floor building when completed.

BRIEF DESCRIPTION OF TABLES AND DRAWINGS

A preferred embodiment of the present invention will now be described with reference to the accompanying drawings in which:

FIG. 18 is a fragmented side view of a position A of the permanent roof structure in the construction process; the permanent roof structure is in its lowest position of the sequence, sitting on the last constructed floor;

FIG. 19 is a fragmented side view of a position B of the permanent roof structure in the construction process; the permanent roof structure is raised to free space for the workers that work on a new construction sub-assembly;

FIG. 20 is a fragmented side view of a position C of the permanent roof structure in the construction process; the permanent roof structure has been lowered to allow a manual installation of the adjustable hoisting means and hook the construction sub-assembly to the permanent roof structure;

FIG. 21 is a fragmented side view of a: Position D of the permanent roof structure in the construction process; the permanent roof structure has been raised from position C to set the construction sub-assembly at the desired height to complete the assembly work of mechanical and electrical systems, conduits, boxes, etc.;

FIG. 22 is a fragmented side view of a position E of the permanent roof structure in the construction process; the permanent roof structure has been raised from position D to allow workers to install the temporary load supporting forms or permanent columns to support the construction sub-assembly;

FIG. 23 is a fragmented side view of a position F of the permanent roof structure in the construction process; the permanent roof structure is lowered from position E onto the temporary load supporting forms or permanent columns for attachment; this will allow to pour the concrete of the new slab and filling of the temporary load supporting forms if applicable (concrete structure);

Figure 1:
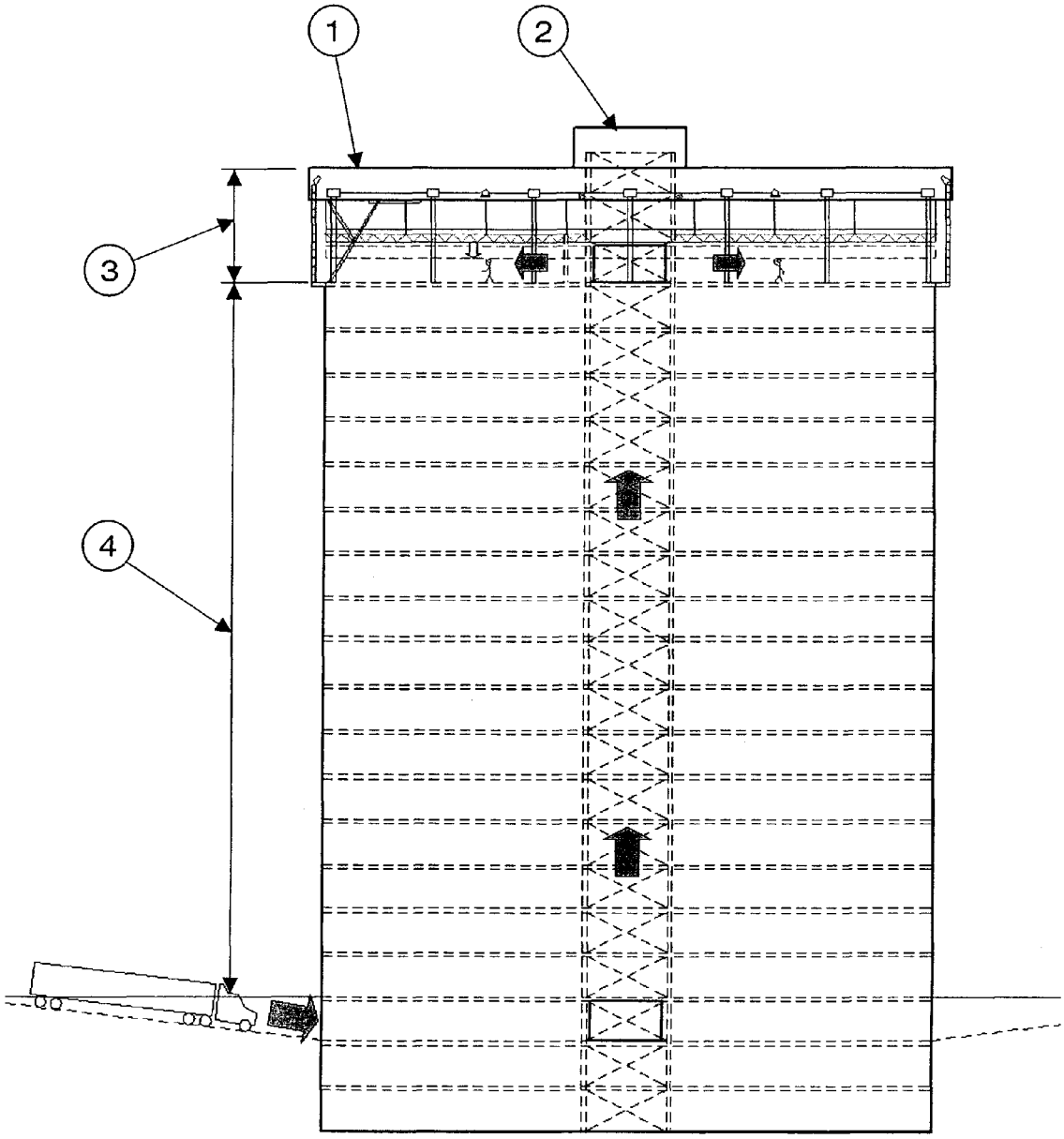
FIG. 1 is an overall side view of a tall multi-floor building, built using the disclosed method and system of the present invention, showing the construction zone over the previously constructed, completed and occupied floors.

FIG. 24 is a fragmented side view of a position G of the permanent roof structure in the construction process; the completed construction sub-assembly sits in its final position after the new concrete slab has been completed; the extensible load support means have been retracted prior to concrete work; the guiding device and permanent retractable wall enclosure has been raised and reattached one floor higher on the building;

FIG. 25 is a fragmented side view of a position H of the permanent roof structure in the construction process; the permanent roof structure is lifted by the extensible load support means and lifts the frame supporting the drive mechanisms of the elevators while guiding them laterally; the structure of the elevator shaft is extended and new bumpers for the drive frame are installed to sit the frame in its new, raised, location; and FIG. 26 is a fragmented side view of a position I of the permanent roof structure in the construction process; the permanent roof structure is lowered and sits on fixed bumpers, attached to the building, and waiting for the next construction phase to begin.

DESCRIPTION OF PREFERRED EMBODIMENTS

Vertically Displaceable Permanent Roof Structure

Referring now to the drawings, the present invention will be described. A permanent roof structure 1 is first assembled on a foundation 48 for the building construction. The shape of the foundation 48 needs to be similar to the shape desired for the floors to build in the future. The permanent roof structure 1 can have any shape, as long as it extends equal to or greater than the desired shape of the floor to build in the future.

Figure 2:
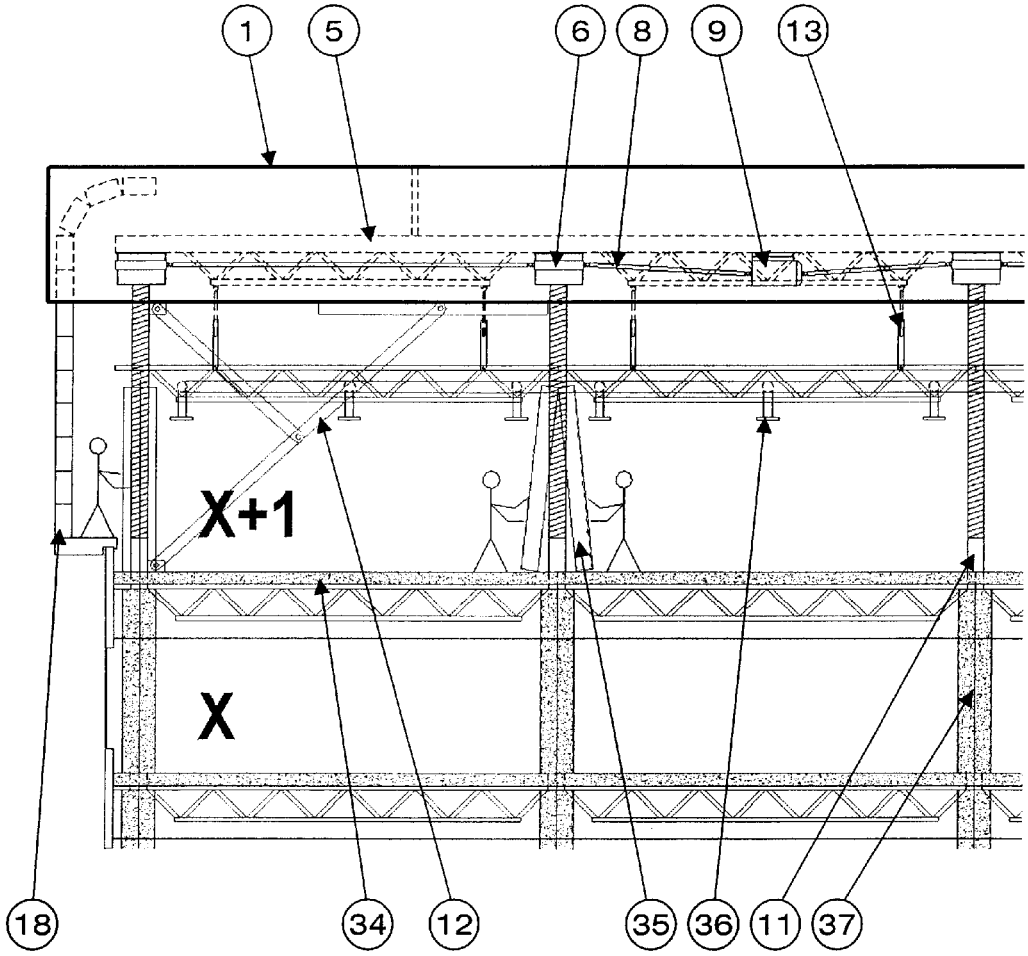
FIG. 2 is a side view illustrating a construction sub-assembly being raised for the installation of the temporary load supporting forms.
Figure 12:
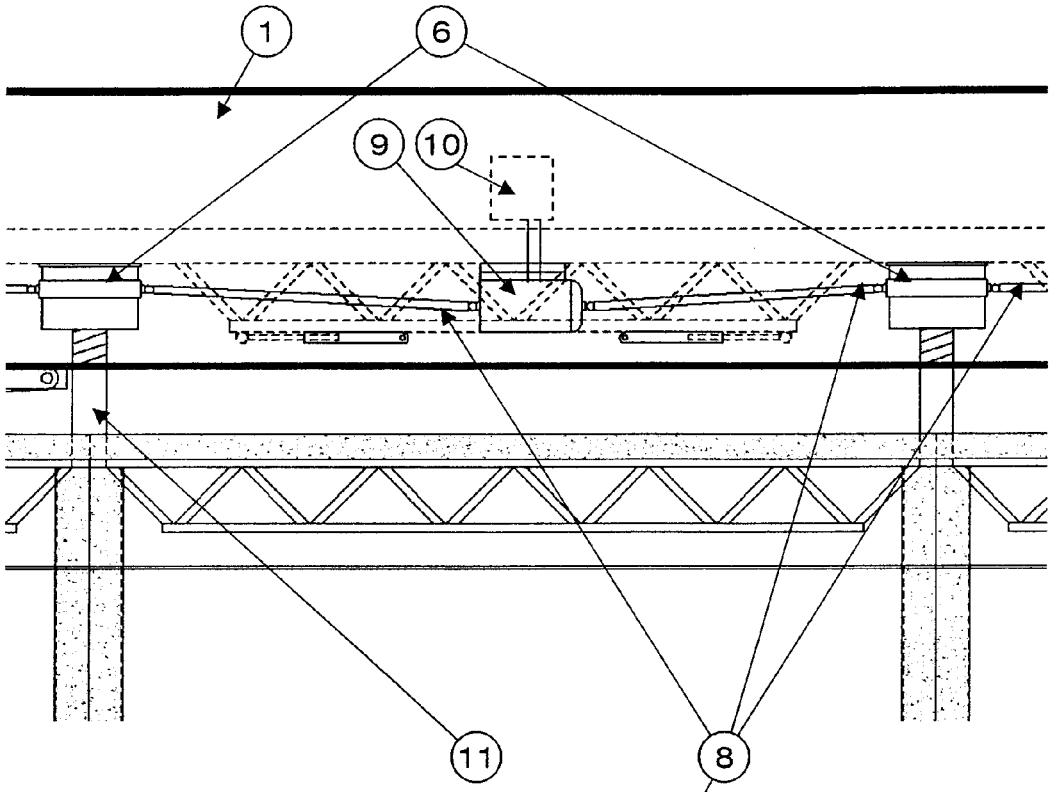
FIG. 12 is a fragmented side view of an example of an arrangement for the extensible load support mean of the permanent roof structure.
Figure 13:
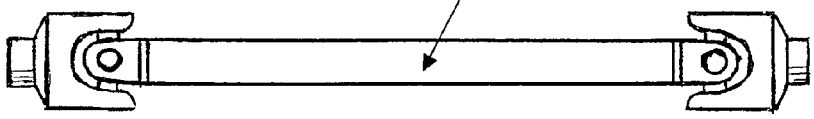
FIG. 13 is a side view of a synchronization means for the extensible load support means, herein a drive shaft with universal joints.
Figure 14:
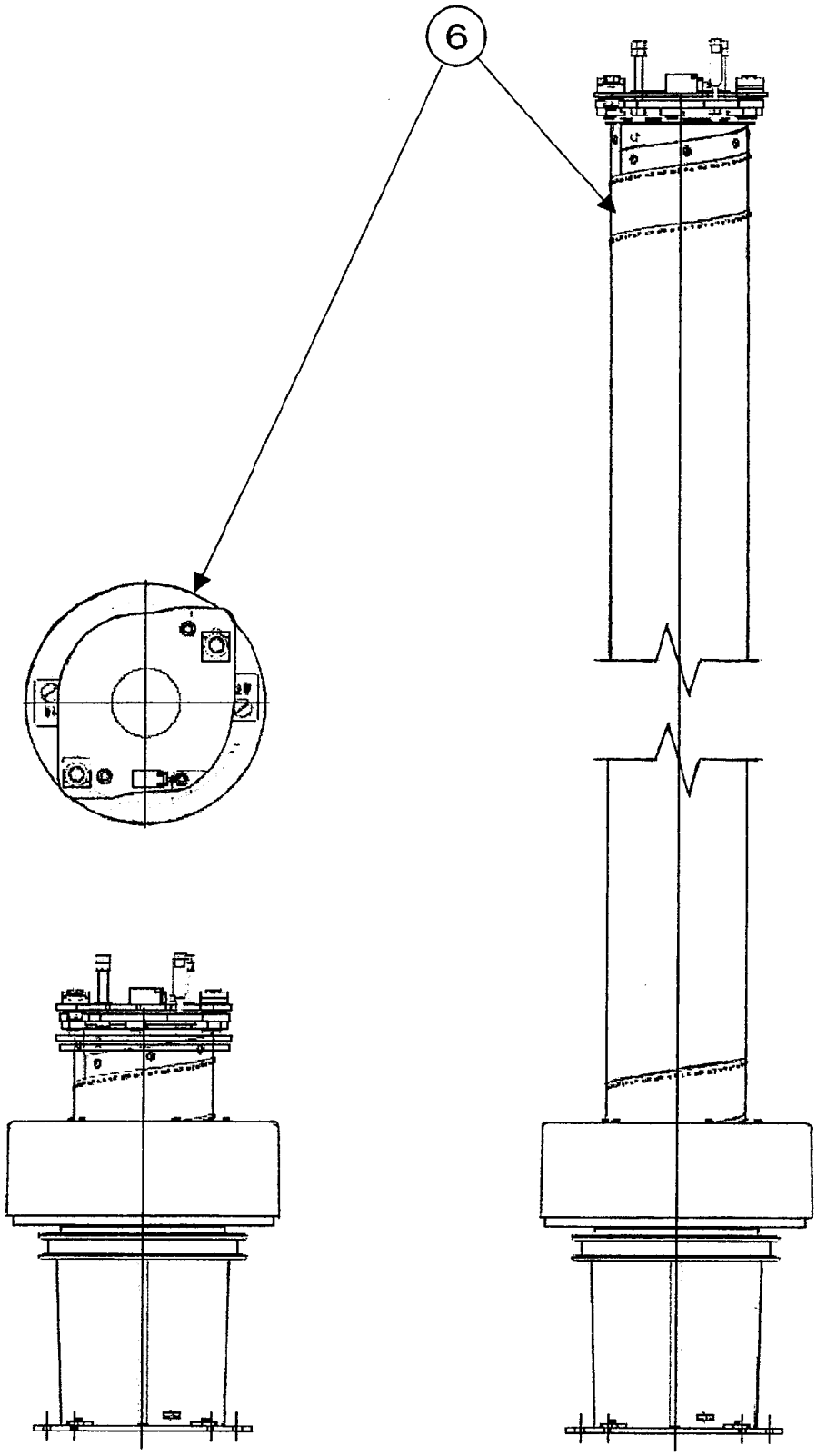
FIG. 14 is perspective view of an extensible load support means constructed by upside down telescopic tubular thrust screws to allow for a compact drive mechanism.
Figure 15:
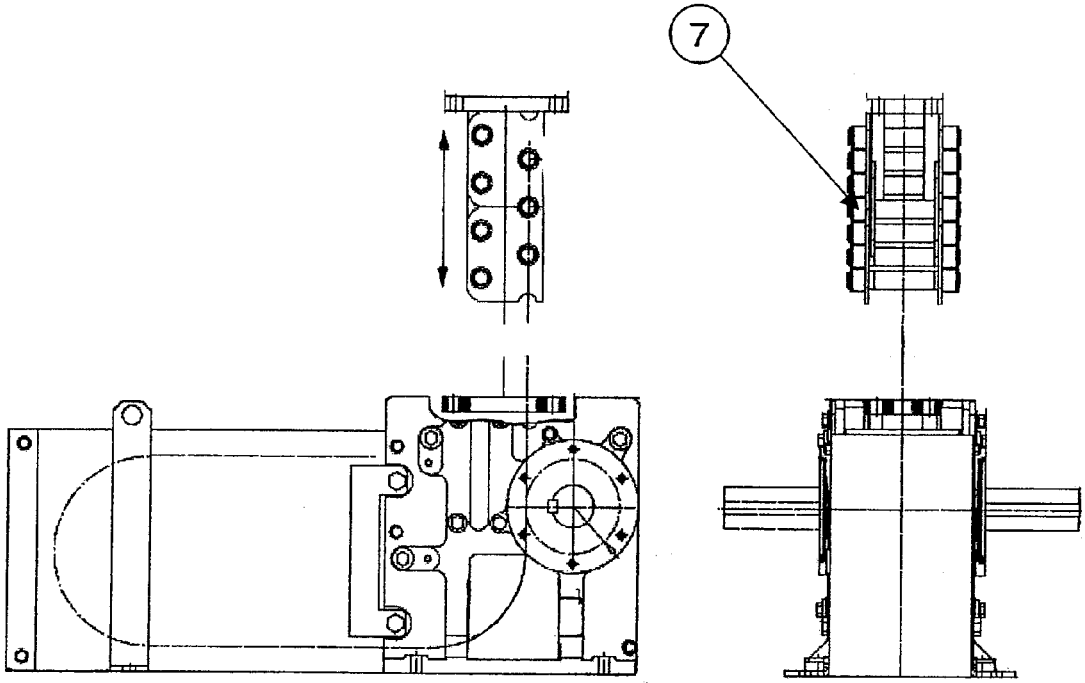
FIG. 15 are side and end views of an alternate extensible load support means constituted by upside down push-pull chain with chain storage inside the permanent roof structure.

The permanent roof structure 1 includes a structure 5 similar to those of conventional roof assemblies. The permanent roof structure 1 is moveable vertically using extensible load support means 6 that are motorized, synchronized and controlled. In order to add a floor when the occupational need to do so arises, the permanent roof structure 1 is raised to create a construction zone 3 under the permanent roof structure for at least one additional floor. Examples of extensible load support means 6 are shown in FIGS. 14 and 15. Any synchronizable extensible load support means can be used to lift the permanent roof structure 1 at pre-determined heights as long as it provides sufficient stroke and lifting force. A synchronization means 8, such as the one shown in FIG. 13, mechanically link all the extensible support means 6. The extensible load support means 6 can be synchronized electronically. The extensible load support means 6 are also linked to gearboxes, not shown, that are selected for proper speed and torque of each specific application. To complete the drive mechanism, electrical brake motors 9 are added to provide driving force to the mechanism. The drive mechanism comprising the motoring element such as an electrical brake-motor, the extensible load support means 6 and the synchronization means 8, have a support base secured, up side down, in the permanent roof structure 1 as shown in FIGS. 2 and 12 to provide an upward pushing force on the roof structure. The extensible load support means 6 are located either in-line with some identified supporting element 37 of the foundation 48 or close to the foundation 48 supporting element 37 or at any location capable of supporting the extensible load support means 6 and total load said extensible load support means 6 are supporting.

The extensible load support means 6 are normally supported on an interface element 11 that sits directly on the last floor constructed or can even be embedded in the concrete slab and remain there permanently. For concrete structures, the interface elements 11 have sufficient openings that allow concrete to flow through to fill the temporary load support forms 35 with the re-bars 51 inside. The interface elements 11 are specifically designed for each project and also incorporate vibration dampers (not shown) to reduce vibration transmission from the driving mechanism of the permanent roof structure 1 into the building structure and reduce noise, if required, to the occupied floors thereunder.

The permanent roof structure 1 is equipped with electrical power, lighting, heating, compressed air, and fresh water supply and has multiple outlets as required in any construction site. These services to the permanent roof structure 1 are permanently connected to the building services through valves, flexible conduits and cable trays.

Control System and Electrical Power

The control system of the permanent roof structure 1 includes at least one control panel 10 housing a programmable logic control element and electrical control relays where all the safety interlocks and operation interface are connected to control the operation of the permanent roof structure 1. The control panel 10 is located at any safe and convenient location and can be wired with extensible cables (not shown) or through a cable tray (not shown) if required. The electrical brake-motors are connected to power disconnect junction boxes (not shown). Permanent junction boxes (not shown) are located on the last floor 34 in any required location to allow electrical connections and continuity. An interface panel (not shown) is provided to the operator to communicate any fault during the operation. The permanent roof structure 1 also incorporates all the safety devices required for a safe operation (visual warnings, audible warnings, interference detectors, stroke limit switches . . . ) (not shown).

Adjustable Hoisting Means

Figure 8:
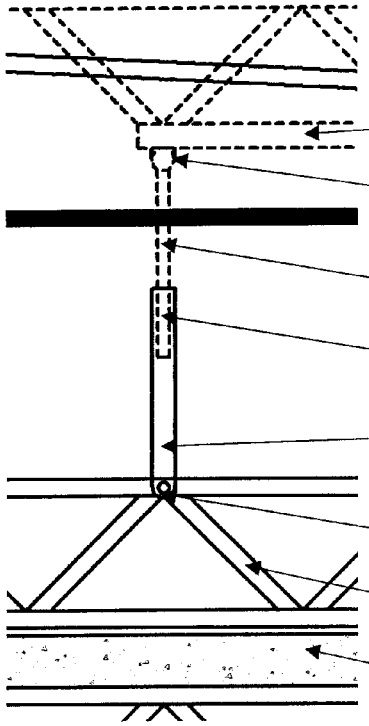
FIG. 8 is an enlarged fragmented side view of a detail for the adjustable hoisting means able to hook a construction sub-assembly to the permanent roof structure; the adjustable hoisting means are also capable to support the permanent roof structure onto the construction sub-assembly when the construction sub-assembly sits on the floor, to allow the extensible load support means to be retracted.
Figure 9:
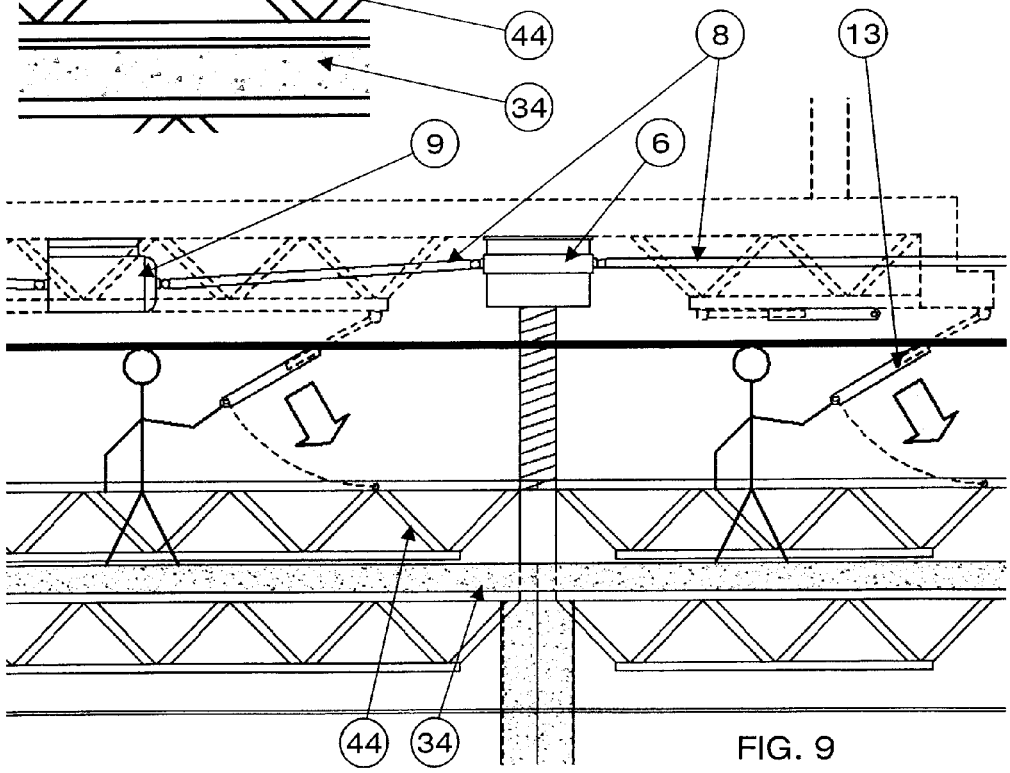
FIG. 9 is a fragmented side view illustrating the manual operation and installation of the adjustable hoisting means to attach it to the construction sub-assembly.

The permanent roof structure 1 is equipped with adjustable hoisting means 13 as shown in FIGS. 2, 8 and 9. There are multiple adjustable hoisting means arranged to cover the complete surface of the building floor to distribute the load of the construction sub-assembly 44 as required over the entire permanent roof structure 1.

When beginning the construction, a new construction sub-assembly 44 is assembled on the foundation 48, or the last floor constructed 34. The construction sub-assembly 44 incorporates all the construction materials and components of a typical building floor, without the vertical elements. The adjustable hoisting means 13 purpose is first to hook the construction sub-assembly 44 to the permanent roof structure 1 in order to synchronize the vertical movement of the construction sub-assembly 44 to the extensible load support means of the permanent roof structure 1. Second, the purpose of the adjustable hoisting means 13 is to act as a bumper to support the permanent roof structure 1 onto the construction sub-assembly 44, when the construction sub-assembly 44 sits on last floor 34, during the time that the extensible load support means 6 are retracted into the permanent roof structure 1 to be reattached on the top portion of the temporary load supporting forms 35.

The adjustable hoisting means 13 comprise adjustment means 15 and 16 to adapt to normal construction variations. The end 17 is attached to the construction sub-assembly 44 with a positive fixation method, such as bolts and safety pins, not allowing separation if impacted by an interfering object. The length of the adjustable hoisting means 13 is specific to each application.

The adjustable hoisting means 13 allow the workers to adjust the height of the construction sub-assembly 44, as it is desired, at any stage of the construction work, using the extensible load support means 6 of the permanent roof structure 1. This allows the workers to work at the best ergonomic and most productive heights during the construction work, for example when assembling horizontal conduits of plumbing, ventilation conduits, and electrical wires. It also allows the operator of the permanent roof structure 1 to lift, once completed, the construction sub-assembly 44 to a pre-determined height to allow the installation of the permanent building columns or temporary load supporting forms 35 when building a concrete building structure.

Guiding Device

The permanent roof structure 1 must remain aligned and stable during vertical movement using a guiding device. The guiding device is a novel arrangement of some of the already known guiding elements such as scissors (not shown), lambdas 12 (see FIG. 2), telescopic bars (not shown) or any element attached to the permanent roof structure 1 and following, by friction or rolling, a structural element, such as an extensible central structural core 38 (see FIG. 4A) serving as an elevator shaft of the building. Collapsing guiding element such as scissors and lambdas 12 can be attached to the last floor 34.

The guiding device purpose is to counteract any external lateral forces that could potentially move the permanent roof structure 1 laterally if it was unguided. Such lateral forces include wind, seismic forces and others. When there is no construction work, the permanent roof structure 1 is attached to the building through positive fixation and the permanent roof structure 1 sits directly on the interface elements 11 that are then used as bumpers and anchor blocks.

Wall Enclosure

Figures 10, 11A:
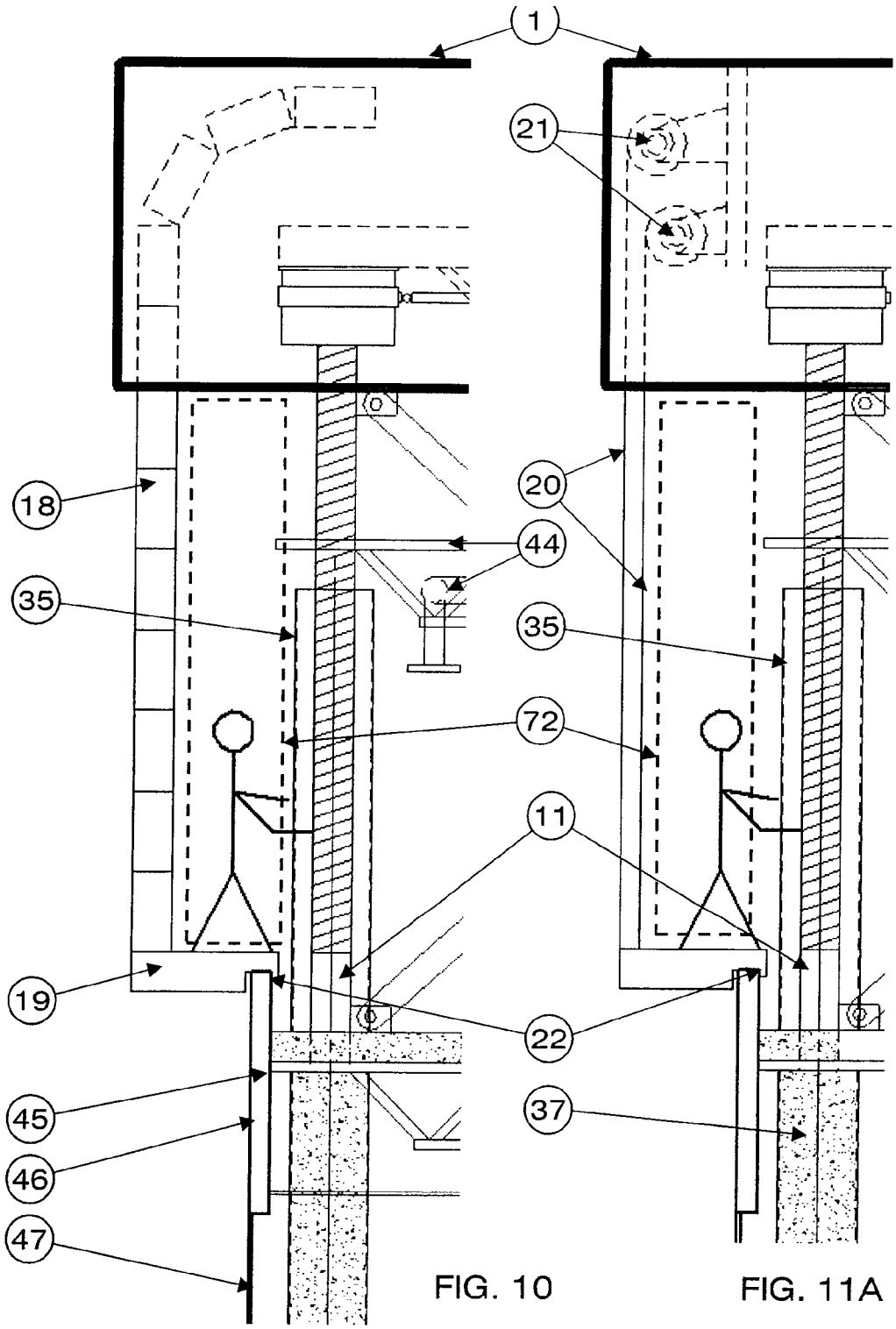
FIG. 10 is a fragmented side view illustrating a permanent retractable wall enclosure constructed with rigid panels and an example of an anchoring method to the building.
FIG. 11A is a view similar to FIG. 10 of an alternate permanent retractable wall enclosure constructed with a heavy-duty tarpaulin, single or multiple layers, attached to a lower rigid platform anchored to the building.
Figure 11B:
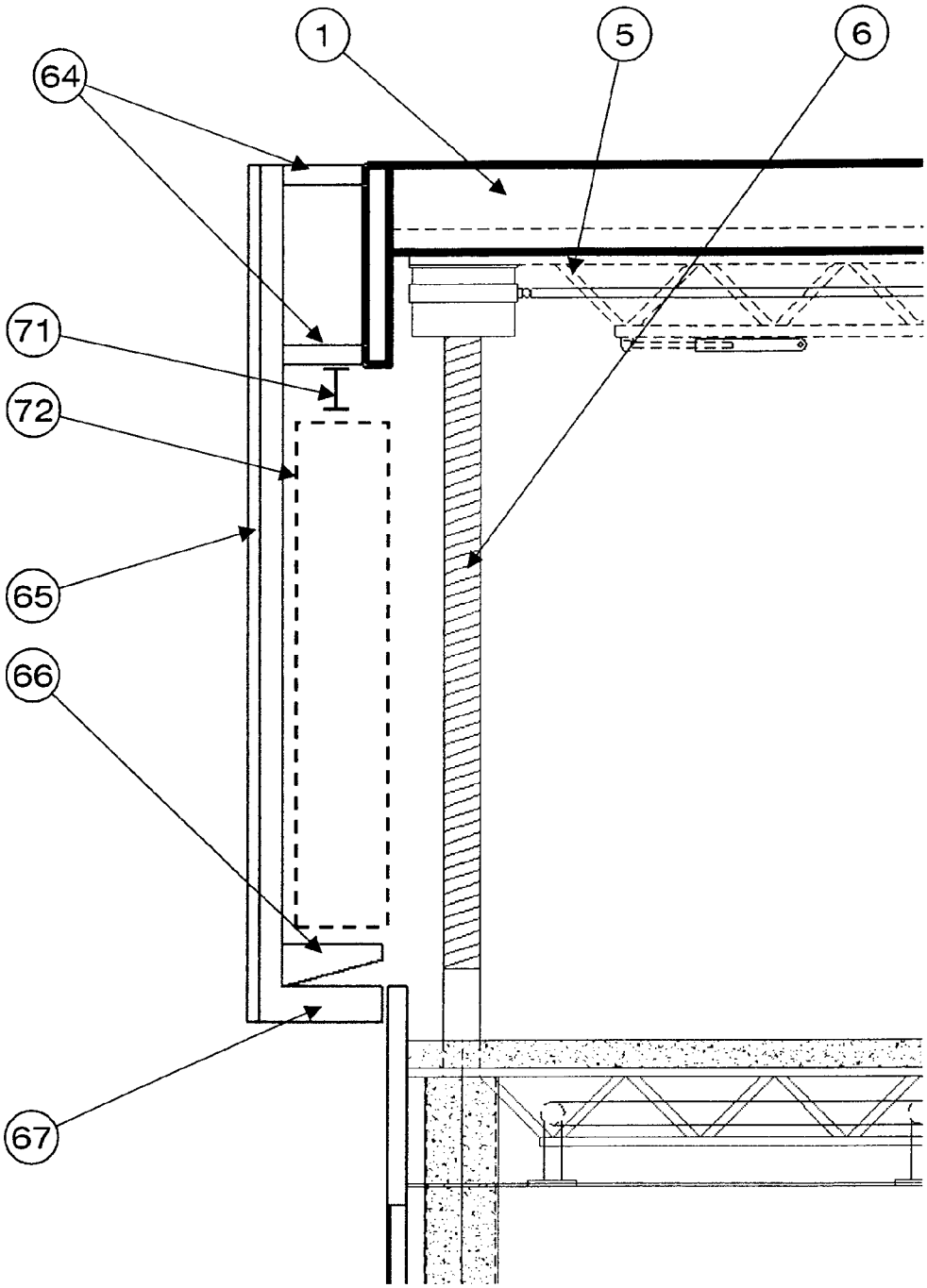
FIG. 11B is an enlarged fragmented side view of an example of a temporary wall enclosure assembled with multiple removable structures or panels secured to the permanent roof structure.
Figure 11C:
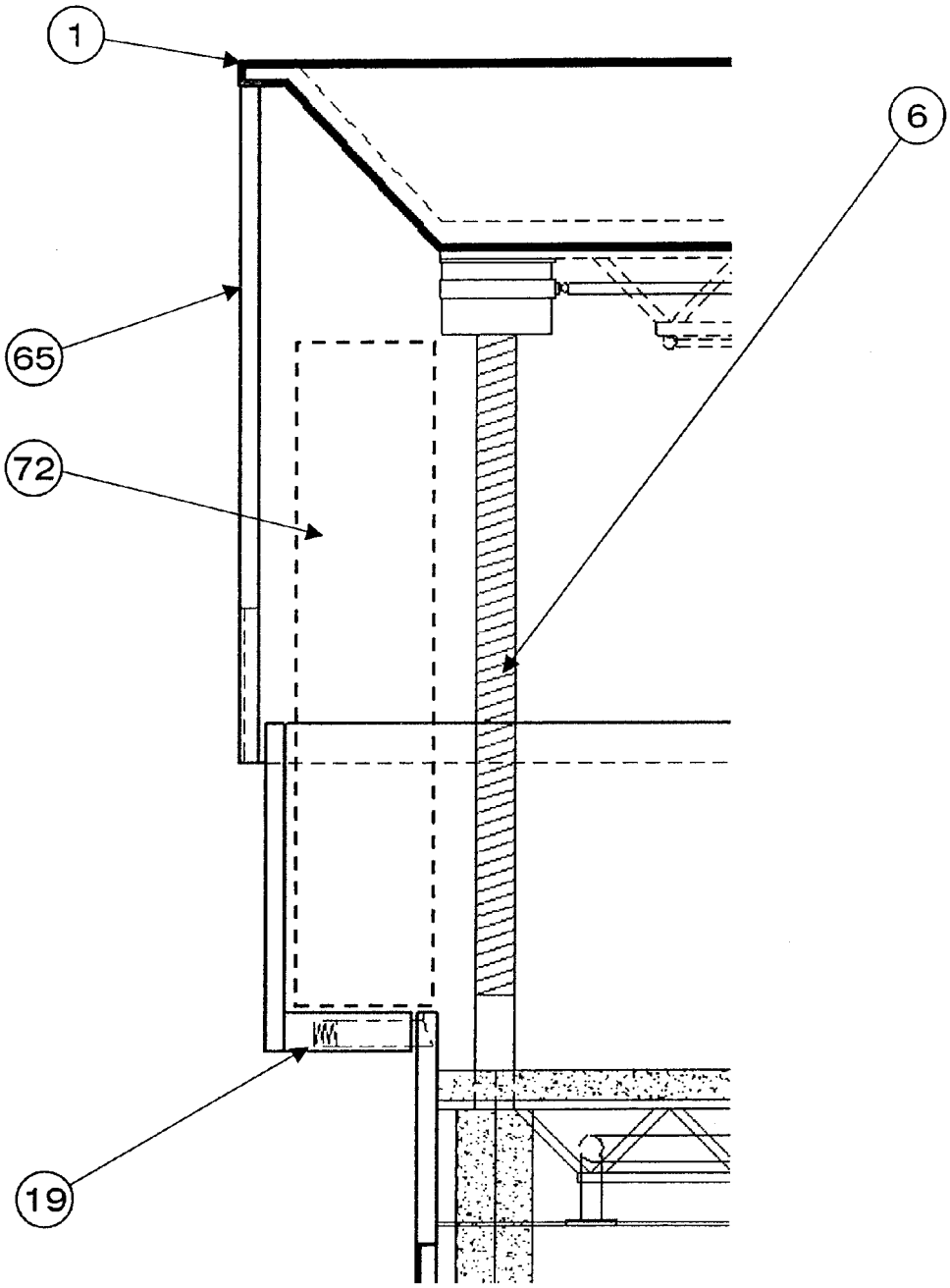
FIG. 11C is a view similar to FIG. 11B illustrating a temporary wall enclosure assembled with multiple removable and telescopic structures or panels secured to the permanent roof structure and the building.

As shown in FIGS. 10 to 11C, a permanent retractable wall enclosure 18 shields the construction zone 3 under the roof from inclement weather conditions and prevents objects from falling off the construction zone 3 of the building. The permanent retractable wall enclosures 18 defines a working space 72 peripheral to the construction zone 3 and the building 34 in order to provide more space for the construction work to occur. This space being larger than the construction zone 3, it also allows easier assembly of the building envelope components 45 and 46. The working space 72 is supplied by a peripheral material handling mean 71 comprising a linear support mean that can carry multiple types of trolleys, trays, bins and other material handling devices (not shown).

The permanent retractable wall enclosure 18 can be self motorized or anchored on the last floor 34 and extend or retract following the movement of the permanent roof structure 1 driven by the extensible load support means 6. The permanent retractable wall enclosure comprises a wall either constructed with articulated rigid panels, such as shown in FIG. 10, or accumulating like an accordion, or a membrane 20 accumulating on a drum 21. The membrane 20 is made of resistant material and can be multi-layer when required. At the base of the permanent retractable wall enclosure 18 and 20 is a rigid platform 19 accessible to workers. The rigid platform 19 is safely attached to the building by a positive fixation means 22. The permanent retractable wall enclosures 18 and 20 can be equipped with windows to provide natural lighting to the construction zone 3.

The temporary wall enclosure as shown in FIG. 11B shields the construction zone 3 similarly to the permanent wall enclosure 18 but it can be removed once the building has reached its final elevation. The temporary wall enclosure comprises a retractable rigid platform 67, multiple adjustable rigid platforms 66 accessible to workers or for construction materials, multiple exterior shell sections 65, upper retractable supporting members 64 to secure the exterior shell sections 65 to the permanent roof structure 5, sealing components (not shown) and a removable device (not shown) to easily and safely remove the panels once the construction is complete. The temporary wall enclosure is assembled early in the construction process, after the completion of the permanent roof structure 1. Once assembled, it is at least partially rigid and fixed to the permanent roof structure 1 and therefore follows the same vertical displacement during construction. The exterior shell sections 65 are similar to each other except for corner elements (not shown) that are fitted to the building dimensions. An alternate concept could also use telescopic exterior shell sections as shown in FIG. 11C wherein the bottom sections could have the platform 67 attached to the building. Another alternate concept could use the vertical displacement of the permanent roof structure 1 for the removal of the exterior shell sections 65 instead of a specific removal device (not shown).

High Capacity Vertical Transportation Means

One or multiple high capacity vertical transportation means, such as a permanent dedicated high capacity freight elevator 24, internal or peripheral to the building, are accessible from the first basement or ground level and allow construction material and components to be transported efficiently to the construction zone 3. The building is equipped with an access ramp 39 that trucks 43 use to unload merchandises, materials and components at a dock 42 or a transfer deck 69 equipped with handling equipment such as a dock lift 41, jib cranes and other equipment. Materials and components are transported to a permanent high capacity freight elevator access 40 using standard material handling equipment such as forklift trucks (not shown).

Figure 3:
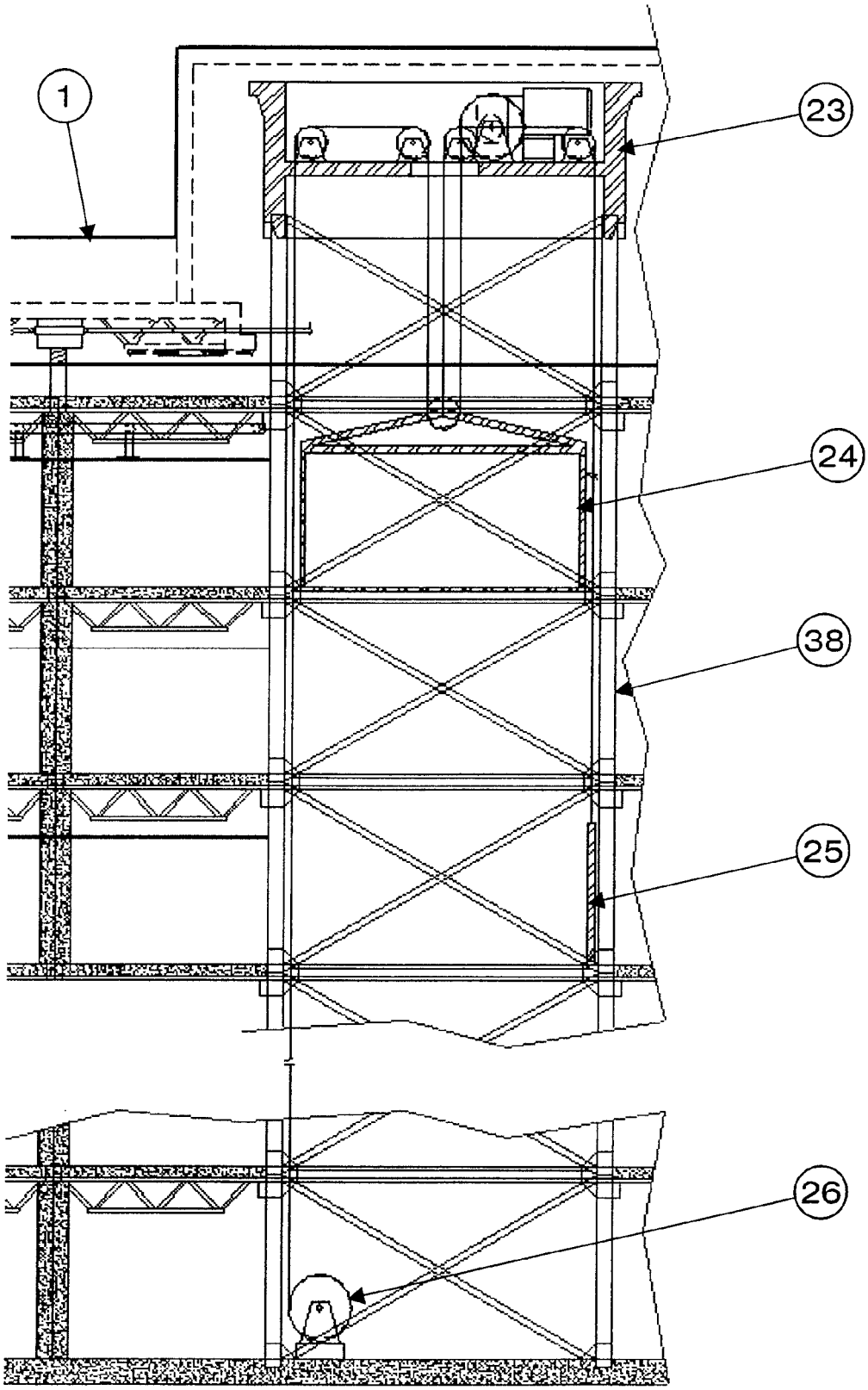
FIG. 3 is a fragmented side view of the high capacity and extensible freight elevator or occupants elevator.
Figure 4A:
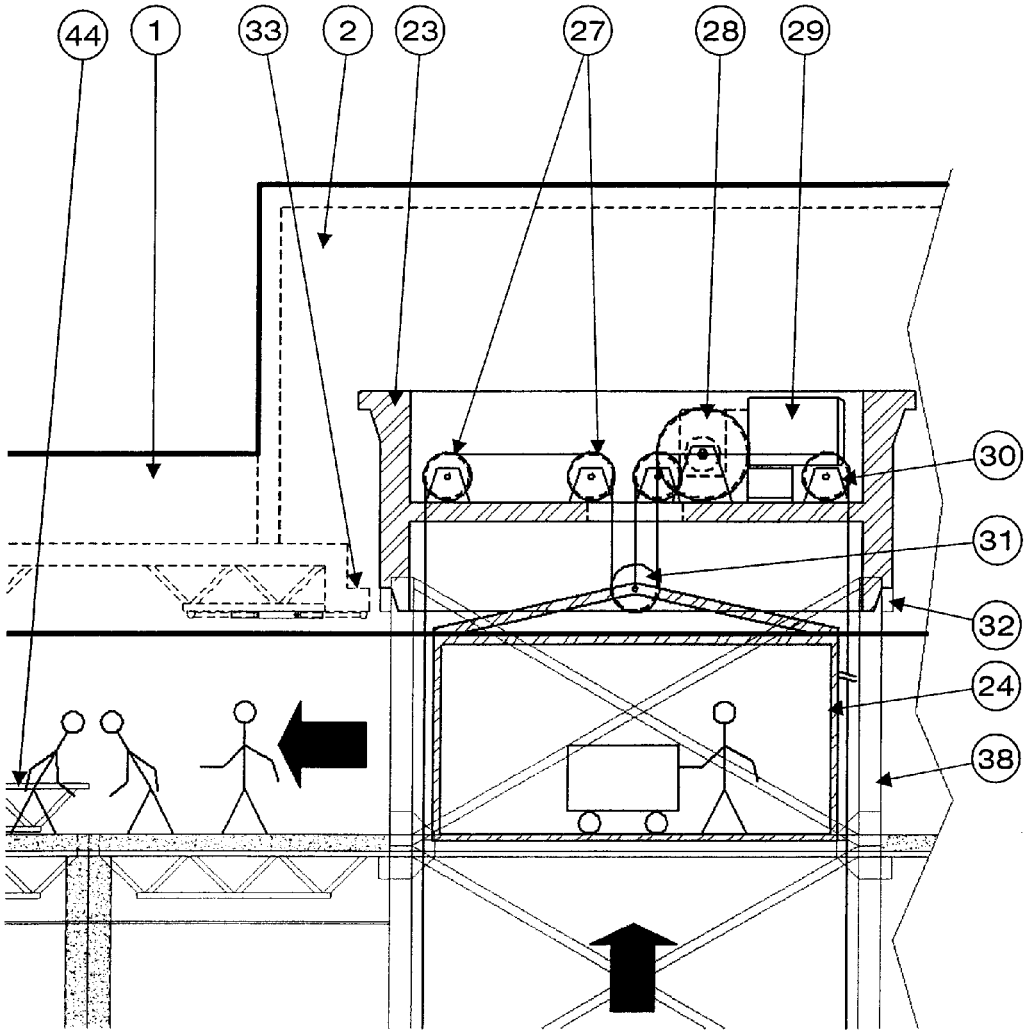
FIG. 4A is a fragmented side view of the driving means of an extensible freight elevator in position to feed the construction zone.

The high capacity vertical transportation means, FIGS. 3 and 4A, is installed at the same time as the permanent roof structure 1, on the building foundation 48, in order to be useful at the very early stage of the building construction. The load capacity, the speed and the size, are project specific. The permanent high capacity vertical transportation mean 24 includes a frame support 23 supporting the drive mechanism components comprising a motoring assembly 29, pulley systems 27, 30 and 31, a cable accumulation drums 26 and 28, a set of supporting bumpers 32, a counter weight 35, a cage 24 and any other components (not shown) to respect applicable standards.

As shown in FIG. 4A, the supporting frame 23 normally sits in a set of support bumper 32 attached to the building structure 38. In order to extend the building structure 38, a set of catcher 33, part of the structural element 5 of the permanent roof structure 1, picks up the frame 23 to raise it at a predetermined height, as the permanent roof structure 1 is lifted by the extensible load support means 6. Said catcher 33 could also be part of the support frame 23 in order to be operated from the elevator equipment.

When adding a floor to the building, the effective stroke of the permanent vertical transportation mean 24 needs to be adjusted by adapting the control system such as changing a register in the program of the programmable logic controller (not shown), by extending the guide rails (not shown), by relocating the travel limit switches (not shown). To extend cables, it is possible to secure the cage 24 to the building structure 38 with pins or bumpers (not shown). The extra cable required has to be already available on an accumulation drum 26 (see FIG. 3) that is normally locked, but is released during the operation of lifting the frame 23. While frame 23 is lifted by the extensible load support means 6 of the permanent roof structure 1, the accumulation drum 26 releases the amount of cable required for the cage 24 additional stroke. From the beginning of the construction, the accumulation drum 26 needs to store the cable required for the maximum stroke the cage 24 will ever do, otherwise the cable will need to be changed in the course of the construction.

Figure 4B:
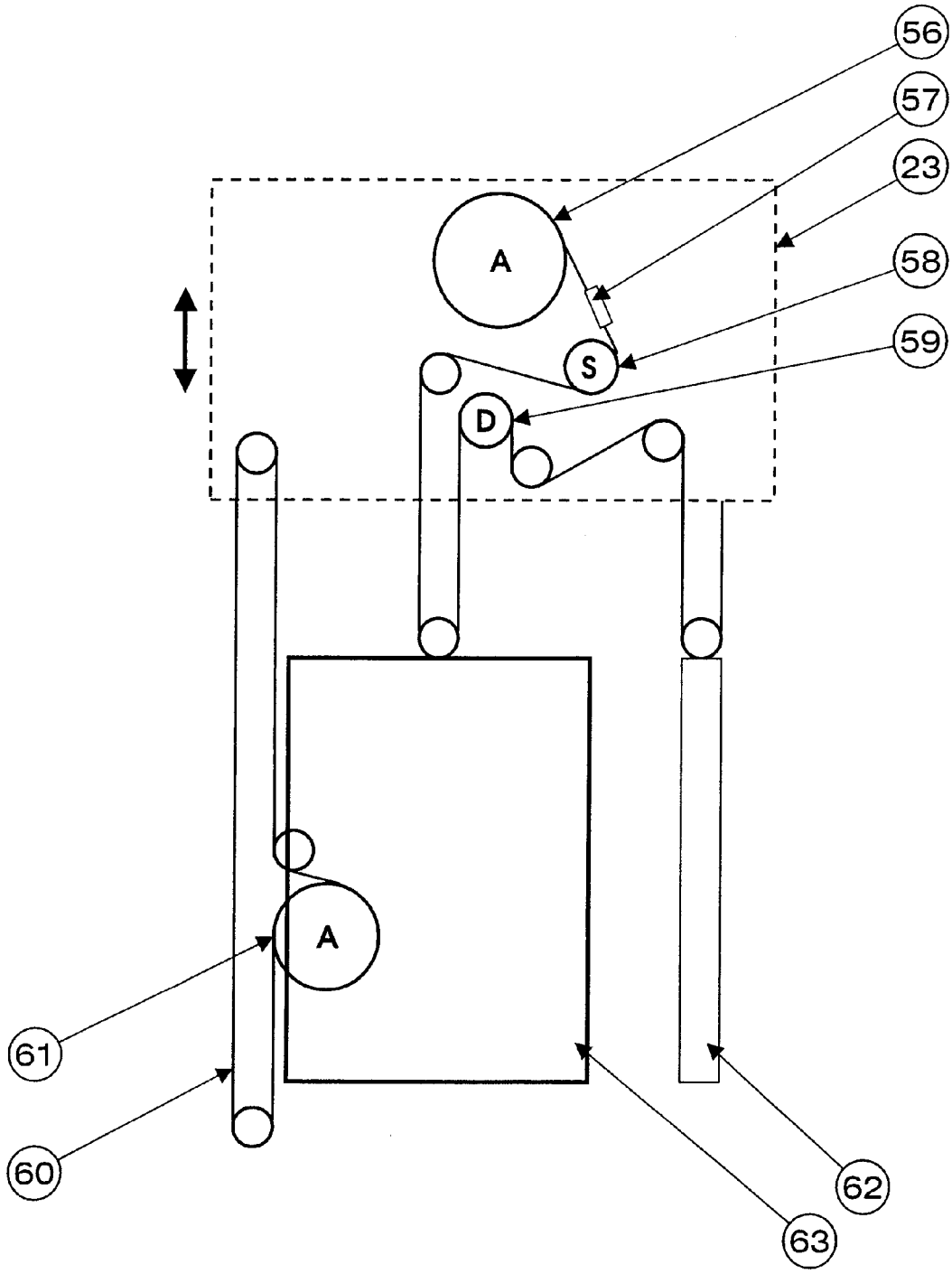
FIG. 4B is a side schematic view of a mobile upper traction drive mechanism for the extensible occupants elevators.
Figure 4C:
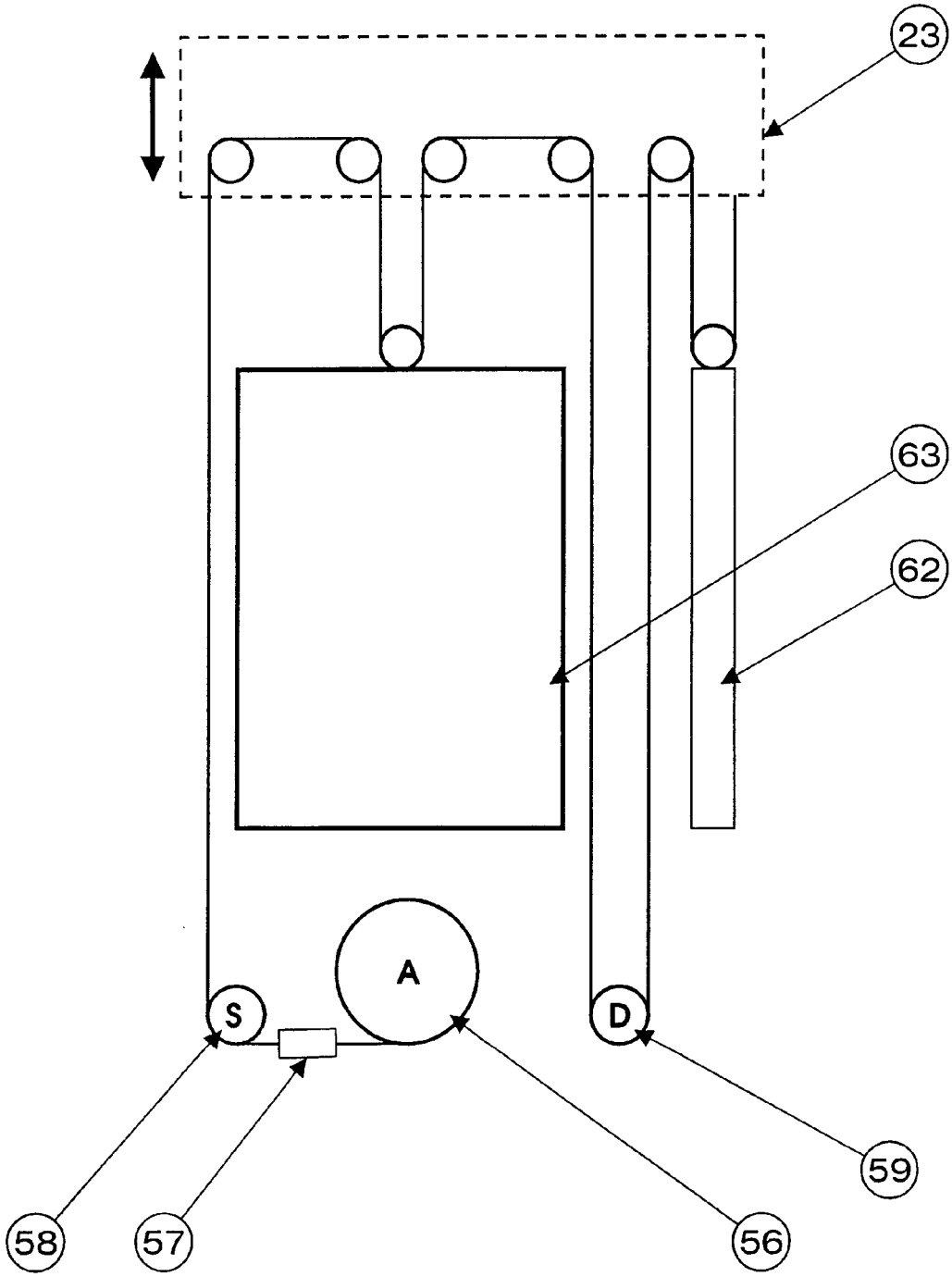
FIG. 4C is a side schematic view of a base mounted traction drive mechanism for the extensible occupants elevators.
Figure 5:
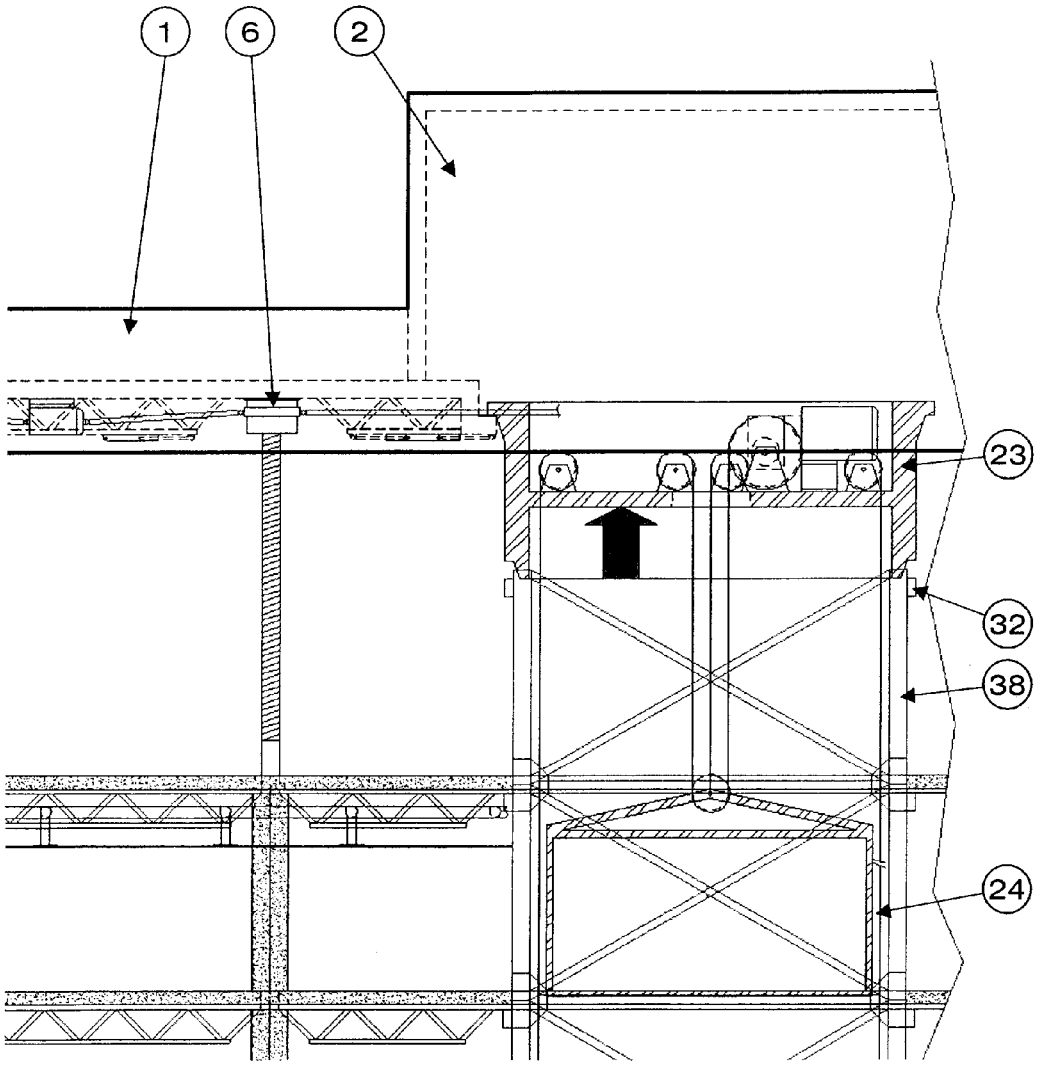
FIG. 5 is a fragmented side view of the permanent roof structure lifting the support frame of an elevator drive mechanisms for its extension.
Figure 6A:
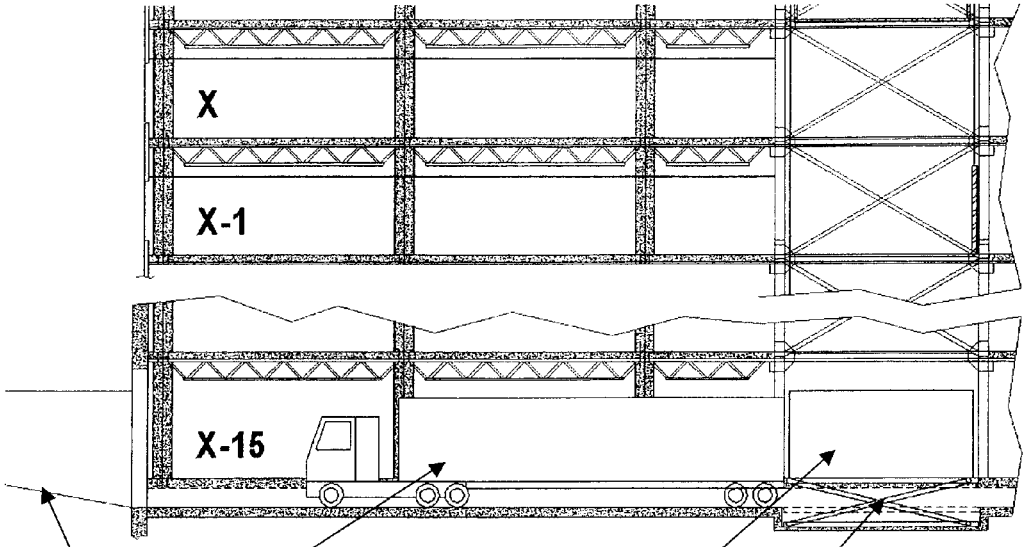
FIGS. 6A and 6B are side views of an unloading dock equipped with dock lift to unload trucks efficiently.
Figure 6B:
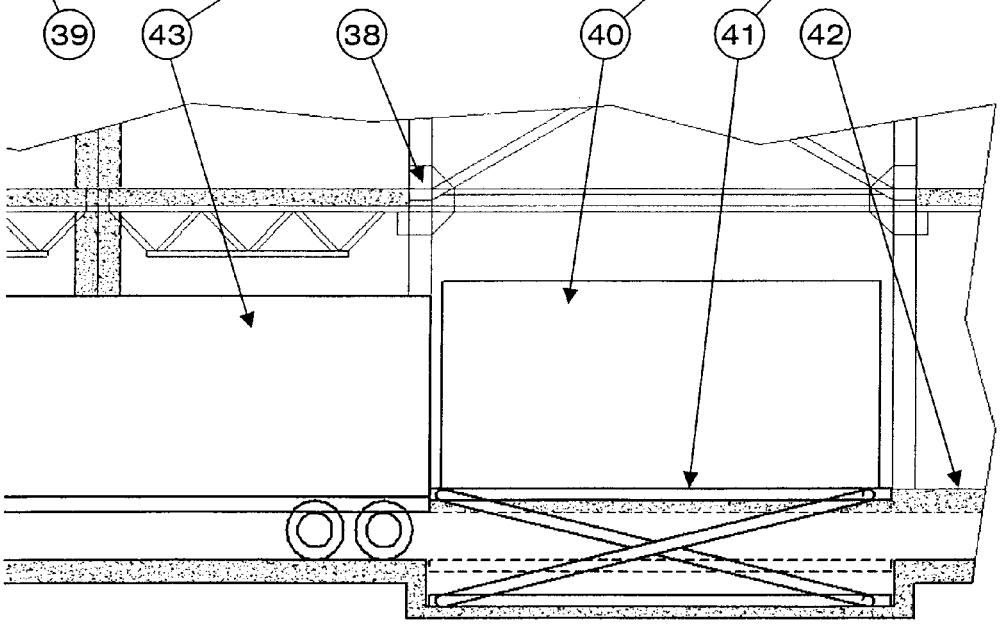
Figures 7A, 7B, 7C:
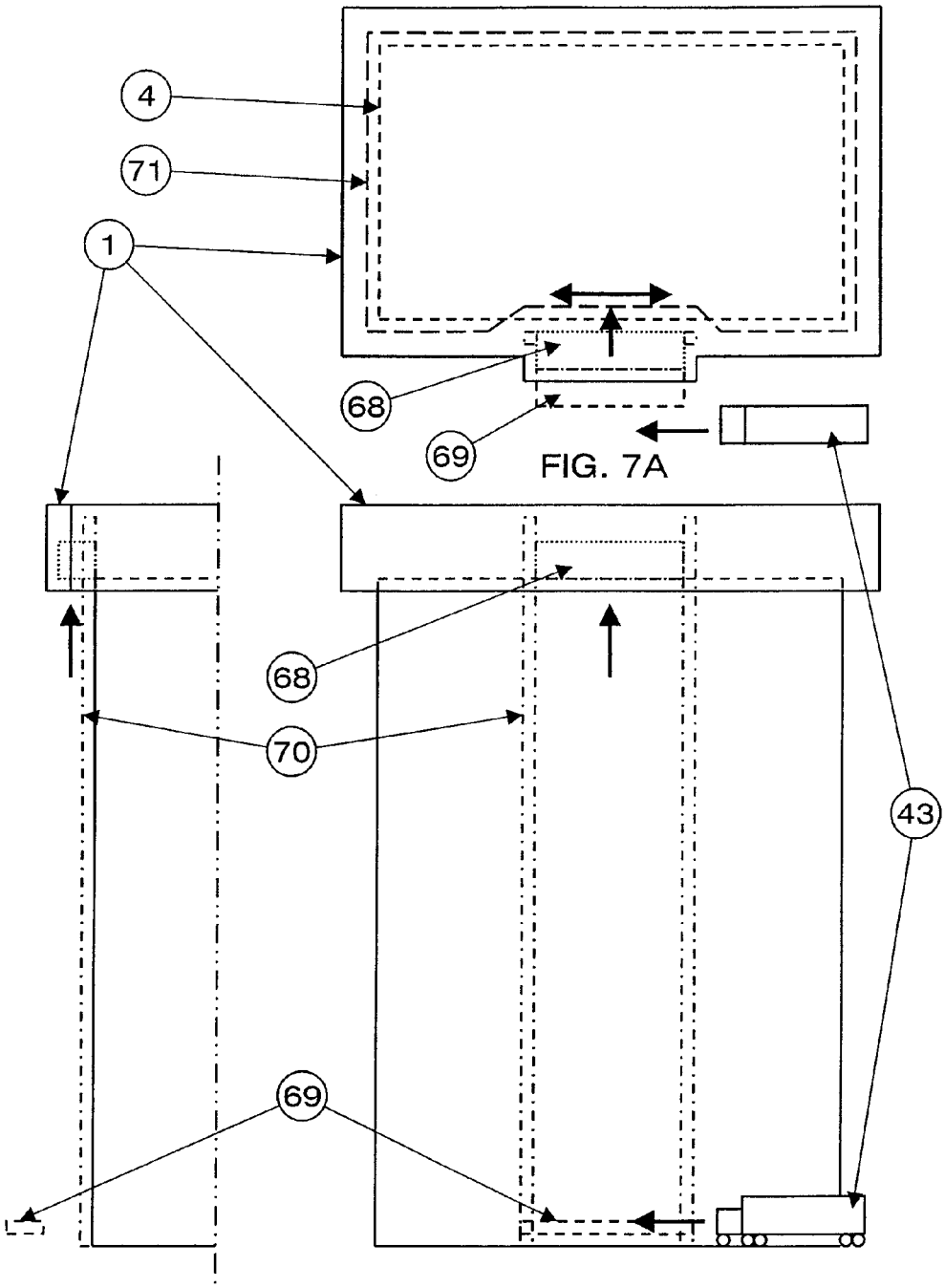
FIGS. 7A to 7C are top and side views of a concept of temporary high capacity and extensible freight elevator and unloading dock located in a controlled area on the perimeter of the building and accessing the construction zone underneath the wall enclosure.
Figures 7D, 7E, 7F:
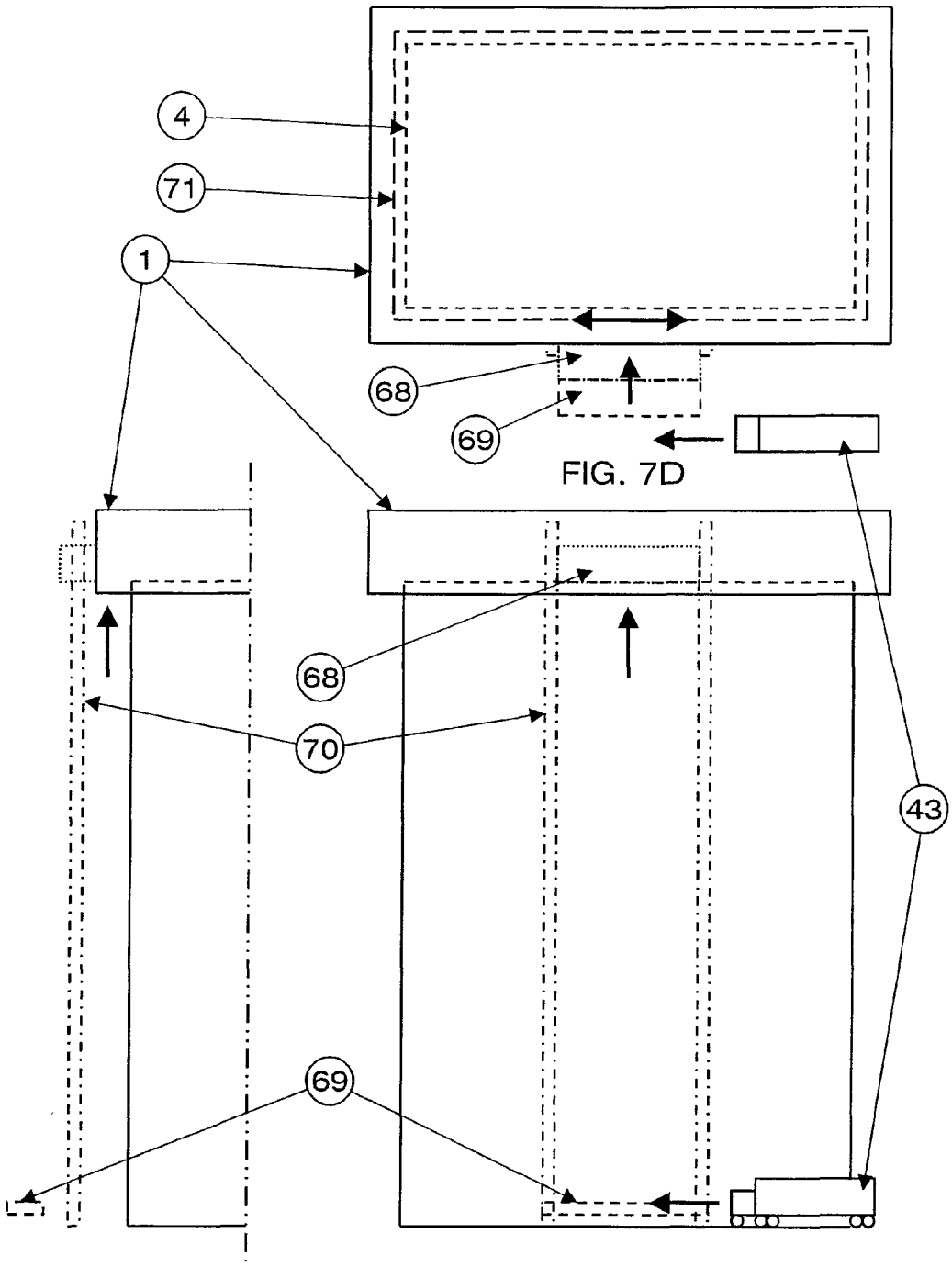
FIGS. 7D to 7F are top and side views of a concept of temporary high capacity and extensible freight elevator and unloading dock located in a controlled area on the perimeter of the building and accessing the construction zone from outside and through the wall enclosure.

The high capacity vertical transportation means can be permanent, temporary, internal or peripheral to the building. An example of a concept for a temporary high capacity transportation means is shown in FIGS. 7A to 7C and is a peripheric transportation cage 68 displacing materials vertically from a transfer dock 69, at unloading level, to the construction zone 3 above, accessing from underneath or from outside a temporary wall enclosure as shown in FIG. 11B, passing through its platform 67 and stopping within the exterior shell sections 65, or stopping at an access door on the exterior shell without entering the wall enclosure, as shown in FIG. 7D to 7F. Such a system allows to unload trucks 43 efficiently to the transfer deck 69 when the peripheric transportation cage 68 is not available. Also, it allows efficient handling of materials once they reach the construction zone 3 where the materials can be transferred to a peripheric materials handling rail 71 for ergonomic materials handling. The drive mechanism of the peripheric transportation cage 68 can use an extensible cable drive as shown in FIG. 3 to FIG. 5, or another suited cable or chain drive, or have at least one drive and guide columns 70 specifically designed for the application.

The permanent roof structure 1 is equipped with a covered opening 2 offering sufficient clearance for the vertical movement required during the construction without interfering with the building structure 38.

The permanent vertical transportation mean 24 is also used post-construction to move occupant's goods or during renovation projects while a temporary system is removed once the construction is completed.

Construction and Extension of the Building Structure

The new construction system and method described here works well with conventional steel construction method having lightly adapted components and standard connections. The structural components are transported using the permanent vertical transportation mean 24 and material handling equipment, standard or specialized (not shown). The new construction system and method hereby can also use a specific column design where the column is made of at least two components assembled around the extensible load support mean 6. Finally, the new construction system and method works well with hybrid or concrete building structures where temporary load supporting forms 35 are used to support the construction sub-assembly 44 while the extensible load support mean 6 are retracted to be reattached on top of an open interface element 11 that allows concrete to flow through.

Figures 16A, 16B:
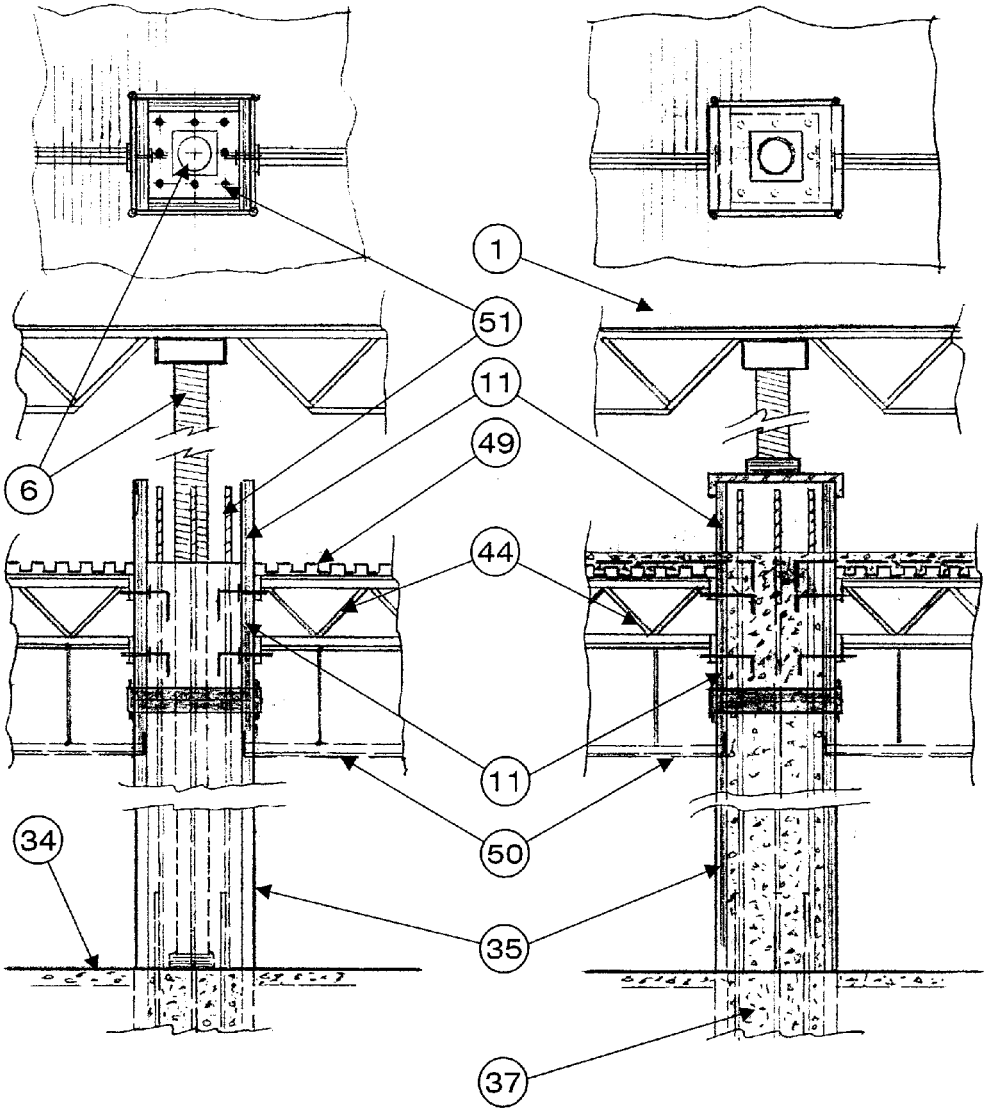
FIG. 16A and FIG. 16B are side views with accompanying top views of an example of fabrication for the temporary load supporting forms having a removable temporary lower portion and a permanent top portion remaining in the concrete.

For buildings with hybrid or concrete structures, the re-bars 51 installation is complete around the extensible load support mean 6 without preventing it to be retracted further in the construction. The temporary load supporting forms 35 are circumscribing the re-bars assembly 51 sub-assembly with the specified clearance. Since the re-bars 51 and the interface elements 11 extend above the concrete surface, it is possible to have continuity in the concrete structure from bottom to top. The extensible load support means 6 are retracted back in the permanent roof structure 1 before the concrete is poured. The construction sub-assembly 44 is supported by the temporary load support means 35 that are also used as concrete forms to pour concrete. The temporary load supporting forms 35 are equipped with a top interface, herein a top support cap 35', that is capable of supporting the construction sub-assembly 44 and provide the next attachment points for the base of the extensible load support means 6. The extensible load support means 6 retract inside the temporary load supporting forms 35 and are reattached on the top portion of the temporary load supporting forms 35. FIGS. 16A and 16B show a concept where the top permanent portion of the temporary load supporting form 35 becomes the interface element 11. In such case, the interface element 11 is providing support for the construction sub-assembly 44 and sits on top of the temporary load supporting form 35. FIG. 16B specifically shows the extensible load support means 6 retracted and reattached on top of interface element 11, which projects above the uppermost floor together with the re-bars assembly.

Because of the light construction of the permanent roof structure 1, the extensible load support means 6 do not require to be positioned exactly in-line with the load bearing columns of the foundation 48 or the building best support points, unlike other known methods. The extensible load support means 6 are located either in-line with some identified supporting element 37 of the foundation 48 or close to the foundation 48 supporting element 37 or any point capable of supporting the extensible load support means 6 and total load that the extensible load support means 6 are supporting.

Figures 16C, 16D:
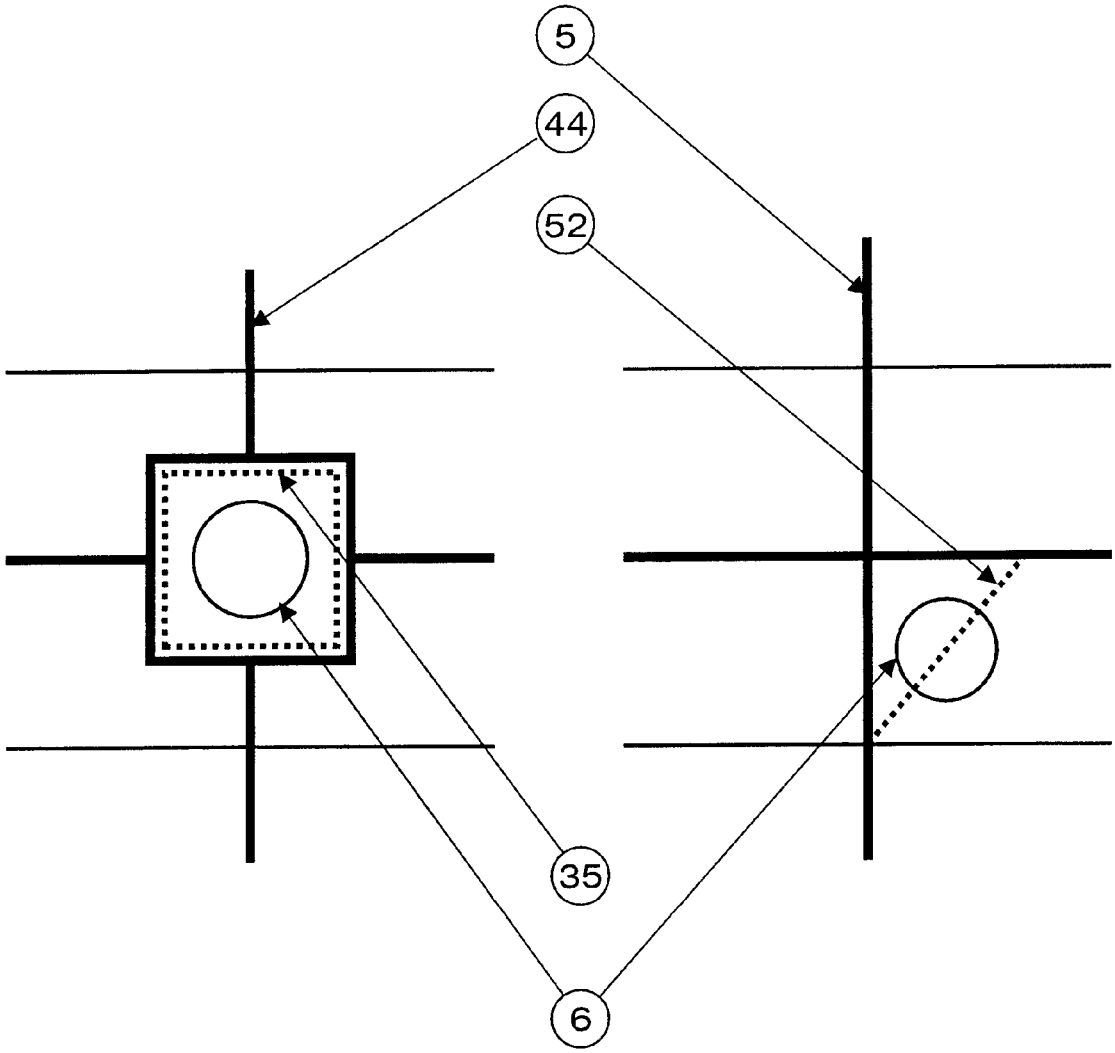
FIG. 16C is a plan view of a typical arrangement when extensible load support means are aligned with permanent load supporting means of the building.
FIG. 16D is a plan view of a typical permanent roof structure with an adaptation when extensible load support means are offset from permanent load support means of the building.

FIG. 16C shows a plan view of a typical arrangement when the extensible load support means 6 are aligned with the permanent supporting element 37 of the building. In the concept shown, the temporary load supporting forms 35 are also used to protect the lower portion of the extensible load support means 6, to guide and to secure the mobile sub-assembly 44. In movement, the sub-assembly 44 follows the temporary load supporting forms 35 that also protects the extensible load support means 6. At rest, a locking mean, such as a lock pin (not shown), is used to secure the sub-assembly 44 to the temporary load supporting forms 35. As an alternate solution, the extensible load support means of FIG. 16D shows a plan view of a typical permanent roof structure 5 connection with an adaptation 52 when the extensible load support means 6 are offset from the permanent supporting element 37 of the building.

Extension of the Electrical and Communication Systems

Additional connectors, junction boxes and panels are installed to allow connection of new occupational floors to the existing electrical system. New cables can run all the way to the main panel in some cases and shielded bars are extended when adding a floor as the occupational need to do so arises. The access for electrical connections is set up on the last floor 34, ready for the next construction phase. A floor main disconnect is already installed on the last floor 34 and is closed once the electrical work has been completed in the construction zone 3 and the construction sub-assembly 44.

Extension of Main Conduits for Plumbing, Fire Protection, Ventilation . . .

The main conduits for water, fire protection, ventilation and sanitary drains typically reduce in size from floor to floor as it goes up in the building. The main conduits of the first floor, for example, must be designed adequately for the future needs and be able to sustain the demand when the number of floors increases. The main conduits are extended using extra sections of conduits. The ends of the conduits are equipped with valves, quick connecting devices, sealing caps or removable covers. Valves are necessary to allow the connection of a new network on a pressurized conduit without disturbing the operation of the existing portion. It is possible, when required, to elaborate a double network of conduits, temporary or permanent, in order to avoid service interruption to the occupied floors 4 under the construction zone 3.

Extension of the Occupants Elevator Shafts and Stroke

The occupants elevator drives and the mechanical room for elevators can be located in the basement, in the elevator shaft or above the elevators, on a frame similar to the frame 23 shown in FIG. 25, or in a displaceable enclosed mechanical room comprising a bottom frame similar to the frame 23 and a covering mean to enclose the mechanisms. With the displaceable drive concepts, the permanent roof structure 1 needs to plan for clearance to allow its vertical movement without interfering with the occupants elevator mechanical room or frame 23.

When extending the building as the occupational need to do so arises, the sequence and method for extending the elevator shaft 38, the guide rails, the cables, the relocation of the travel limit switches and all other components requiring to be extended follow the same principle than the one applicable for the permanent vertical transportation mean 24.

When adding a floor to the building, the effective stroke of the occupants elevators needs to be adjusted by adapting the control system such as changing a register in the program of the programmable logic controller (not shown), by extending the guide rails (not shown), by relocating the travel limit switches (not shown). To extend cables, it is possible to secure the cage 24 to the building structure 38 with pins or bumpers (not shown). The extra cable required has to be already available on an accumulation drum that is normally locked, but is released during the operation of lifting the occupants elevator drive mechanism. While the drive mechanism, or mechanical room, of the elevators is lifted by the extensible load support means 6 of the permanent roof structure 1, the accumulation drum releases the amount of cable required for the elevator cage additional stroke. From the beginning of the construction, the accumulation drum needs to store the cable required for the maximum stroke the elevator cage will ever do, otherwise the cable will need to be changed in the course of the construction.

For traction type drives, the extensible occupants elevator comprises a traction disk or pulley 59, a synchronization drum 58 used only during extension, a cable holding means 57, a cable accumulation means 56, a governor device 60 with its specific governor accumulation means 61, a passenger cabin 63 and a counterweight 62. All the drive components can be mounted on a displaceable frame 23 such as shown in FIG. 4B or partially in an elevator pit such as shown in FIG. 4C. After the guide rails, the shafts have been extended and the travel limit switches have been relocated, an example of extension procedure is to proceed with the following steps:

1. Locate both the cabin 63 and the counterweight 62 at the same reference position,
2. then, the governor accumulation means 61 is unlocked but keeps the governor device 60 in tension,
3. the frame 23 is raised a predetermined distance by the extensible supporting means 6 in the permanent roof structure 1 or separate lifting device,
4. the governor accumulation means 61 is locked at its new extended stroke,
5. the cable holding means 57 and the cable accumulation means 56 are unlocked,
6. the synchronization drum 58 releases cable and lowers the cabin from the same pre-determined distance while the traction pulley 59 remains at rest,
7. the cable holding means 57 and the cable accumulation means 56 are locked,
8. the traction pulley drives the cabin 63 and the counterweight 62 at the same reference position,
9. the extension is complete but the elevator stroke has been increased by the pre-determined distance.

A similar procedure can be used for an elevator pit drive as shown in FIG. 4C. Also, a similar procedure can be completed with the counterweight 62 moving instead of the cabin 63, if the cable accumulation means 56 and the synchronization drum 58 are assembled on the counterweight side instead of the cabin side. Also, step 1 or 9 are not necessary as the verification of correct positioning can be accomplished in many different ways. The occupants elevator extension can be performed one or multiple stories at a time and one or multiple elevators at a time. Finally, the support frame 23 or the mechanical room can sit on top of the elevator shaft structure or be secured within the shaft.

Extension of Stairs

The stairs wells and the elevator shaft always extend higher than the last floor constructed 34. Both are extended as floors are added. The stairs provide access to the last floor constructed 34 and the permanent vertical transportation mean 24 can access the last floor constructed 34 as well in order to start the construction of the next floor as occupational need to do so arises.

Location of the Building Systems Machinery

The description disclosed hereby assumes that the building heating, air conditioning, water treatment and other units are installed mostly at the lower and intermediate levels. If the units are installed on the permanent roof structure 1, the lifting capacity of the extensible load support mean 6 and the driving means 9 are modified accordingly and further adaptation will be required to the conduits network to avoid service interruptions to the occupied floors.

Example of Construction Process Possible with the New Construction System

1. Construction of a foundation 48 having a top shape, or a first floor geometry, similar to the shape desired for the permanent roof structure 1 but not extending the shape of the permanent roof structure 1.
2. Installation of the permanent roof structure 1 at its position A (FIG. 18) on the foundation 48, with a guiding device 12 anchored to the foundation 48. The base of the extensible load support means 6 are fixed to the foundation 48 using an interface element 11.
3. Installation of the permanent retractable wall enclosure 18 and fixation of its rigid platform 19 to the building or a wall enclosure as shown in FIG. 11B or FIG. 11C.
4. Construction of the first sections of the building structure 38 for the elevator shaft and stairs wells.
5. Installation of vertical transportation means or elevator cabin 24 and construction of the first stairs.
6. Mechanical and electrical connection of the systems to provide services to the permanent roof structure 1 and make everything operational.
7. Inspection of the operation of all the systems and safety devices.
8. If occupational spaces are planned within the foundation 48 of the building, the occupational spaces construction can be completed totally or partially at this stage, for normal or temporary usage.
9. In order to create a first standard construction zone 3, the permanent roof structure 1 is lifted at its position B (FIG. 19) by the extensible load support means 6 to create a workspace under the permanent roof structure 1.
10. The structural elements, components and materials are assembled in the construction zone 3 into a construction sub-assembly 44 that sits on the last floor constructed 34 or on adjustable bumpers (not shown). At this stage, the permanent roof structure 1 is lifted high enough by the extensible load support means to allow workers to walk on the construction sub-assembly 44 and to install a steel deck 49 when applicable. The construction sub-assembly 44 typically starts on the outer portion of the floor and progresses towards a permanent vertical transportation mean 24 to simplify material handing during the assembly.
11. Once all the work performed with the construction sub-assembly 44 sitting on the last floor constructed 34 is complete or on bumpers (not shown), the permanent roof structure 1 is lowered at its position C (FIG. 20) to hook the construction sub-assembly 44 to the permanent roof structure 1. A set of adjustable hoisting means 13 is used to hook the construction sub-assembly 44 to the permanent roof structure 1. The adjustable hoisting means 13 allow the workers to adjust the height of the construction sub-assembly 44, as it is desired, at any stage of the assembly work, using the extensible load support means 6 of the permanent roof structure 1. This allows the workers to work at the best ergonomic, and most productive heights during the assembly work, for example when assembling horizontal conduits of plumbing, ventilation conduits, and electrical wires.
12. Once the assembly of horizontally oriented components and materials into the construction sub-assembly 44 is substantially completed, the permanent roof structure 1 and the hooked constructions sub-assembly 44 are lifted at a pre-determined height (position E, FIG. 22) to allow the installation of the permanent building columns or temporary load supporting forms 35 that will support the construction sub-assembly 44.
13. With the columns or temporary load supporting forms 35 in place, the extensible load support means of the permanent roof structure 1 lowers the construction sub-assembly 44 to its final design position F (FIG. 23) where it is attached to the temporary load supporting forms 35.

14. The permanent roof structure 1 is now supported by the adjustable hoisting means 13 on top of the construction sub-assembly 44 that rests on the last floor constructed 34 or on mechanical bumpers (not shown). This allows the extensible load support means 6 to be lifted or retracted back into their storage location into the permanent roof structure 1 and to reattach the bases of the extensible load support means 6 to a newly installed interface elements 11, one floor higher than the bases were previously attached, as shown in FIG. 24.
15. Adjustable hoisting means 13 are folded back into the permanent roof structure 1 and the permanent roof structure 1 can be further lifted to proceed to concrete work, if applicable.
16. Pouring of the concrete into the steel deck 49, on top of the construction sub-assembly 44. The interface elements 11 have sufficient openings to allow concrete to flow through and fill the temporary load supporting forms 35.
17. Removal of the temporary load supporting forms 35 to be reused for the next floor construction.
18. Completion of the vertical conduits installation, construction of interior divisions and connection of the horizontally oriented components of the construction sub-assembly 44 to the vertically oriented conduits. The floor construction can be completed until it is ready for occupation.
19. Pre-fabricated structural elements are added to structure 38 to extend the structure 38 by one floor.
20. While the permanent roof structure 1 is lifted to the position H (FIG. 25) by the extensible load support means 6, a set of catcher 33, part of the structural element 5 of the permanent roof structure 1, picks up the frame 23 to raise it at a pre-determined height. This operation allows the installation of a new set of bumpers 32, one floor higher than the previously installed bumpers.
21. The frame 23 is lowered on its new set of bumpers 32 and attached to the structure 38. The programmable logic controller is reprogrammed, guide rails are extended, and travel limit switches are relocated one floor higher and all other devices of the permanent vertical transportation mean 24 is adjusted to allow for the new stroke. Similar operations are completed in a more complete procedure for the occupants elevators as described previously.
22. The permanent roof structure 1 is lowered to its position I (FIG. 26) and is attached to the building using interface elements 11.
23. Inspection of the construction of the new floor and start up procedure for all the systems is effected. The newly constructed floor can now be occupied.

Each subsequent floor construction typically starts at step 9 of the above construction process.

Figure 17A:
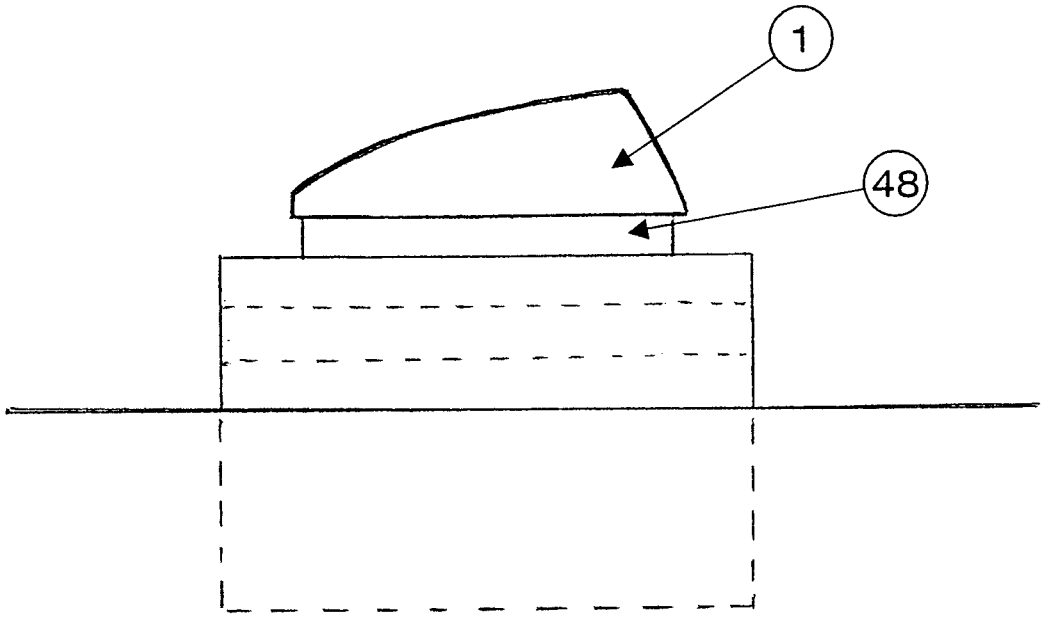
FIG. 17A is a schematic side view of an example of a foundation with an architecturally shaped permanent roof structure installed and ready to be lifted to create a first construction zone.
Figure 17B:
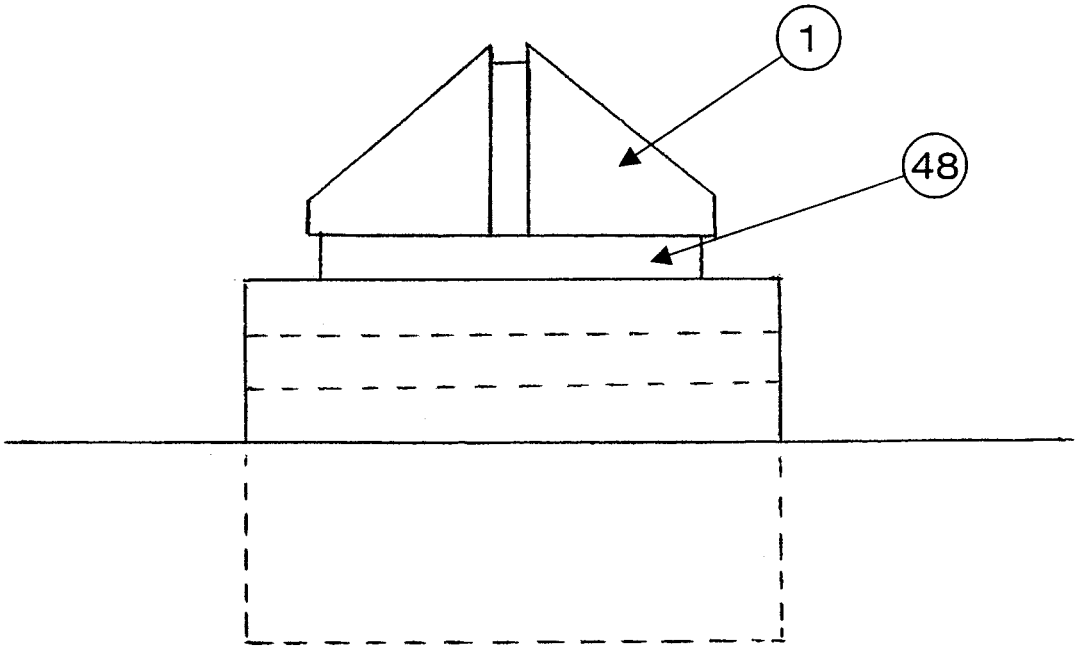
FIG. 17B is a further schematic side view of an example of a foundation with an architecturally shaped permanent roof structure installed and ready to be lifted to create a first construction zone.
Figure 17C:
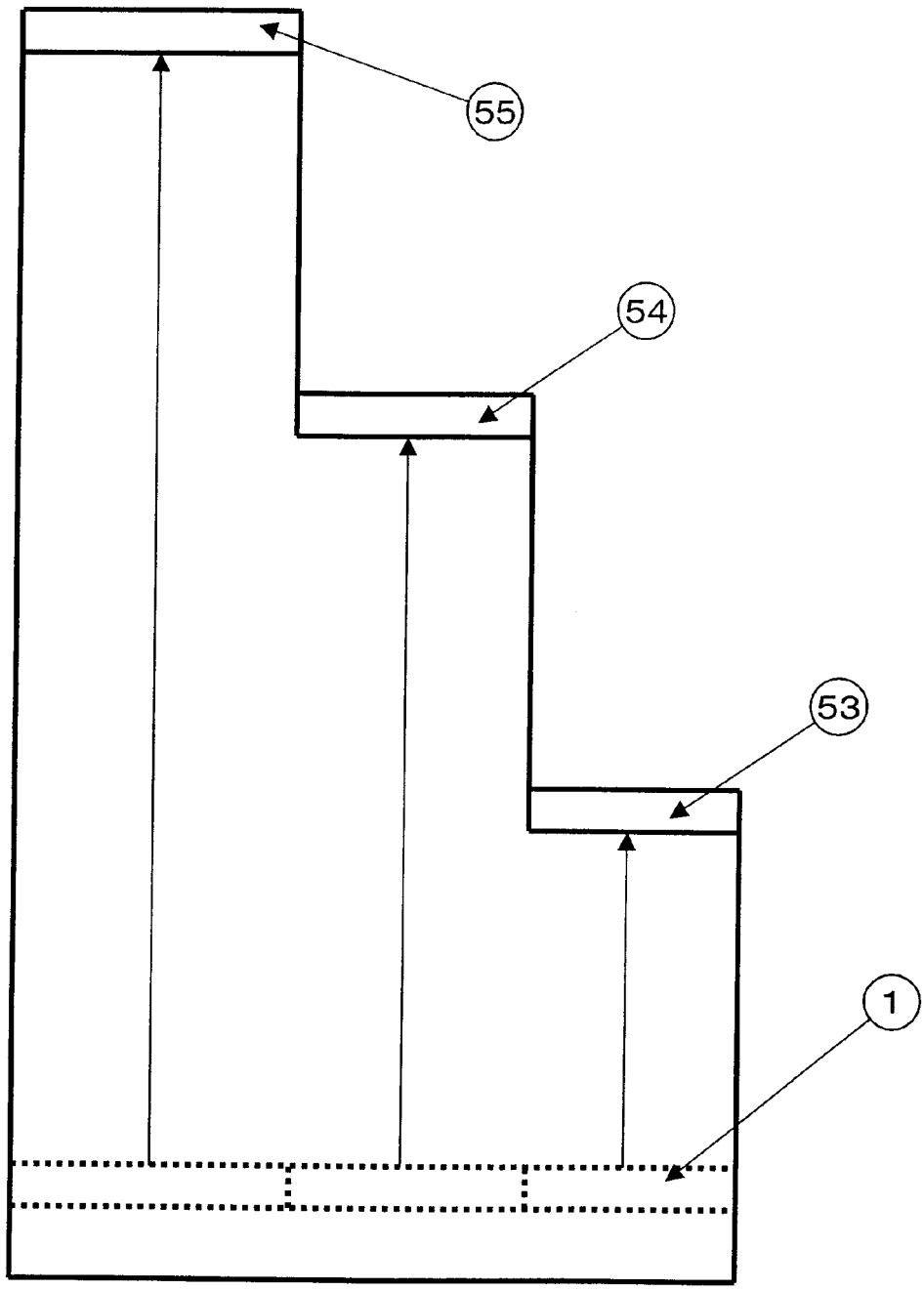
FIG. 17C is a schematic side view of an example of a divided permanent roof structure to accommodate a change of geometry or surface at a given storey or floor level.

The construction process can also be adapted to specific project or building requirements. For example, a divided permanent roof structure 1 as shown in FIG. 17C allows the construction process to adapt to multiple floor size projects. Therefore, when the geometry of surface changes at a given storey or level, a section 53 or 54 of the permanent roof structure 1 can remain on the previously constructed larger floor while the remaining sections continues on. At least on section 55, such as shown in FIG. 17C will continue to the final height of the building, unless an additional architectural or structural element (not shown) is added on top of section 55 as a past phase of construction. It is also contemplated that the construction system can be used as an extension to an existing building. The system also contemplates architectural designs where part or sections of the building is constructed by known conventional methods where specific roof structures are required.

The Table below lists the differences between the features of the disclosed construction system and method of the present invention versus the existing or traditional method of construction.

| TYPE | EXISTING METHODS | NEW METHOD & SYSTEM |
|---|---|---|
| Material | Tower cranes | Enclosed vertical transportation means |
| | Exterior freight elevator | Permenent roof structure equipped with extensible load support means for vertical movement in the construction zone. |
| | Boom lifts | Dock station with dock lift and equipment peripheric monorail |
| | Fork lifts | Fork lifts and other standard handling equipment |
| Ergonomics/ Security | Scissors, Ladders, stepladders, stools | Permanent roof structure locating the sub-assembly anywhere it is required for best ergonomic work position |
| | Scaffoldings | Wheeled trolleys |
| | Temporary heating | Heated, lighted and controlled work environment |
| | Temporary protection against inclement weather conditions | Permanent protection from inclement weather conditions |
| | Temporary guard rails | Wall enclosure |
| Occupants elevator | | Interior permanent extensible elevator |
| Access and control | Exterior unloading | Indoor unloading dock |
| | Exterior offices | Interior offices |
| | Surrounding gates and panels | Controlled access, lockable site |
| Financing | Critical initial occupational ratio | Lease and funds entry as soon as the first floors are completed |
| | Financing on the total investment | Construction, and financing according to, as occupational need to do so arises |
| Occupation | Occupation at the end of the total construction project | Occupation of completed floors simultaneously to construction is possible |
| | | Extensibility of the building systems to maintain services for occupants |
| | | Passenger elevators dedicated to occupants |
| | | Permanent vertical transportation mean for vertical material transportation during construction and for post construction use (renovation, relocation of occupants . . . ) |

It is within the ambit of the present invention to cover any obvious modifications of the preferred embodiment descried herein provided such modifications fall within the scope of he appended claims.

The invention claimed is:

1. A multi-floor building construction system for progressively constructing floors on load-bearing means of a foundation as the occupational need to do so arises and while sub-floors can be occupied, said system comprising a permanent building roof structure displaceably supported over an uppermost floor of at least an upper one of one or more occupational floor space constructed on the foundation, extensible load support means secured in said roof structure and resting upon and pushing against said uppermost floor to support a total load of said permanent roof structure, means to operate said extensible load support means in synchronization to elevate said permanent roof structure to create a construction zone over said uppermost floor of the building structure where an occupational floor space is to be constructed under said permanent roof structure with said permanent roof structure held elevated from said uppermost floor by said extensible load support means, means to transport construction materials within dedicated and enclosed spaces isolated from said occupational floor spaces, occupant services providing means adaptable to said further occupational floor space and integrated with existing occupational floor spaces and adjustable hoisting means secured inside said permanent roof structure for connection to floor sub-assemblies fabricated in said construction zone, said extensible load support means lifting said floor sub-assemblies connected to said adjustable hoisting means while simultaneously raising said permanent roof structure.

2. A multi-floor building construction system for progressively constructing floors as claimed in claim 1 wherein the permanent roof is constructed of roof sections in order to adapt to changing floor geometry or surface from a given floor to a subsequent floor.

3. A multi-floor building construction system for progressively constructing floors as claimed in claim 1 wherein there is further provided temporary removable support means to support said construction material assemblies in a position elevated over said uppermost floor and said total load of said permanent roof structure.

4. A multi-floor building construction system for progressively constructing floors as claimed in claim 3 wherein said temporary removable support means are temporary load supporting forms adapted to form load support columns.

5. A multi-floor building construction system for progressively constructing floors as claimed in claim 1 wherein there is further provided retractable lateral guiding and restraining means to maintain said permanent roof structure stable and in alignment during vertical displacement thereof by said extensible load support means.

6. A multi-floor building construction system for progressively constructing floors as claimed in claim 1 wherein said extensible load support means are motorized and synchronized electronically, said extensible load support means being provided with brake motors.

7. A multi-floor building construction system for progressively constructing floors as claimed in claim 1 wherein said extensible load support means each have a support base secured upside-down in said roof structure to provide an upward pushing force on said roof structure when extended downwards and abutting against said uppermost floor of the building structure.

8. A multi-floor building construction system for progressively constructing floors as claimed in claim 1 wherein there are a plurality of said adjustable hoisting means each being hingeably or detachably connected at a top end to said roof structure and to said construction sub-assemblies at a bottom end, each said adjustable hoisting means being adjustable lengthwise, said adjustable hoisting means supporting said construction sub-assemblies at desired elevations above said uppermost floor in said construction zone by displacement of said extensible load support means whereby to accommodate construction workers.

9. A multi-floor building construction system for progressively constructing floors as claimed in claim 1 wherein said extensible load support means secured in said permanent roof structure are used to vertically displace said permanent roof structure and any construction sub-assembly or building component temporarily supported by said permanent roof structure at desired elevations to facilitate construction tasks to construct said occupational floor space.

10. A multi-floor budding construction system for progressively constructing floors as claimed in claim 1 wherein a displaceable wall enclosure is secured about at least a portion and below said permanent roof structure to secure at least a portion of said construction zone and occupational spaces below.

11. A multi-floor building construction system for progressively constructing floors as claimed in claim 10 wherein said displaceable wall enclosure is a retractable wall enclosure which retracts into a top portion of the permanent roof structure and depends about and spaced from said construction zone, and a rigid platform secured to a lower end of said wall enclosure and detachably securable to attachment means on a peripheral area of said sub-floor.

12. A multi-floor building construction system for progressively constructing floors as claimed in claim 10 wherein said displaceable wall enclosure includes temporary exterior shell elements supported by retractable support members and a rigid platform secured to a lower end of said exterior shell elements.

13. A multi-floor building construction system for progressively constructing floors as claimed in claim 12 wherein said exterior shell is constructed with telescopic wall sections.

14. A multi-floor building construction system for progressively constructing floors as claimed in claim 1 wherein said means to transport construction material includes a high capacity vertical transportation elevator having a support frame detachably secured to said permanent roof structure, said support frame supporting drive mechanism and suspension components including cable accumulation drum, an elevator cage supported by a cable wound on a drum and about a pulley system, said support frame having supporting means for lifting engagement by displaceable lifting means secured to said roof structure whereby to be lifted from elevator shaft walls by the upward displacement of said permanent roof structure by said extensible load support means.

15. A multi-floor building construction system for progressively constructing floors as claimed in claim 14 wherein said transportation elevator is an internal freight elevator, said cage being supported in an elevator shaft extending to said last constructed sub-floor under said permanent roof structure.

16. A multi-floor building construction system for progressively constructing floors as claimed in claim 1 wherein said means to transport construction material is a peripheral freight elevator displaceably secured to extendable temporary guide columns secured to the building structure as it is constructed.

17. A multi-floor budding construction system for progressively constructing floors as claimed in claim 4 wherein there is further provided a re-bar assembly formed about said load support means, said temporary load supporting forms being support column forms circumscribing said re-bar assembly, and access means to pour concrete from a top end of said support column forms after retraction of said load support means.

18. A multi-floor building construction system for progressively constructing floors as claimed in claim 17 wherein there is further provided a top support device disposed at said top end of said forms after concrete has been poured to a predetermined level therein, said top support device providing support for said load support means upon further downward extension of said retracted load support means.

19. A multi-floor building construction system for progressively constructing floors as claimed in claim 18 wherein said predetermined level is at substantially the level of an uppermost floor to be fabricated, said forms and re-bar assembly extending a predetermined distance above said predetermined level.

20. A multi-floor building construction system for progressively constructing floors as claimed in claim 1 wherein said occupant services providing means includes extensible occupants vertical transportation means in service before the building has reached its final height.

21. A multi-floor building construction system for progressively constructing floors as claimed in claim 1 wherein said occupants services provided means comprises at least one displaceable occupants elevator cabin displaceable in an elevator shaft, said occupants elevator cabin having an elevator drive assembly associated therewith, said elevator drive assembly being readjustable upon the completion of said occupational floor space, said readjustment being effected in a control system and by extending associated structures and cables provided on one or more cable accumulation drums.

22. A multi-floor building construction system for progressively constructing floors as claimed in claim 1 wherein said occupants services providing means comprises building supply services secured in said permanent roof structure and adaptable through valves and flexible conduits and cable supports to provide continuing services to the construction zone without interrupting services to said occupational floor spaces as said building structure expands during construction periods.

23. A multi-floor building construction system for progressively constructing floors as claimed in claim 1 wherein there is further provided a peripheral enclosure to protect construction operations and said construction zone and occupational floor spaces under said construction zone and defines a working space for constructing a budding envelop.

24. A multi-floor building construction system for progressively constructing floors as claimed in claim 23 wherein a peripheral material handling and conveying means is provided in said peripheral working space and supplies materials to the peripheral working space for the construction of said building envelop.

25. A method of constructing a multi-floor building progressively, floor-by-floor, by adding floors above an uppermost occupational space as the need to do so arises and while sub-floors can be occupied, said method comprising the steps of:

i) providing a load-bearing floor with load-bearing means;

ii) constructing a permanent roof structure over said load-bearing floor;

iii) securing extensible load support means in said permanent roof structure and aligned to rest upon or in close proximity to at least some of said load-bearing means to support a total load of said permanent roof structure, said extensible load support means being adapted to be operated in synchronization;

iv) lifting said permanent roof structure a predetermined distance above an upper occupational floor space to create a construction zone above said occupational floor space to construct one or more additional occupational floor spaces as said need to do so arises;

v) providing materials to said construction zone with at least one vertical transportation means displaceable in a dedicated enclosure isolated from the occupational floor space;

vi) providing occupant services to said one or more additional occupational floor spaces and integrated with existing occupational floor spaces;

vii) securing adjustable hoisting means inside said permanent roof structure to support floor sub-assemblies fabricated in said construction zone; and (viii) lifting said floor sub-assemblies secured to said adjustable hoisting means by actuating said extensible load support means while simultaneously lifting said permanent roof structure.

26. A method as claimed in claim 25 wherein there is further provided the step of constructing at least one extensible occupants elevator and an internal or peripheral freight elevator, securing a support frame to said permanent roof structure above or inside an extendable elevator shaft; said support frame supporting drive mechanism and suspension components, disposing a passenger cabin or freight cage in said elevator shaft, securing said cable to said passenger cabin or freight cage and a counter-weight, resting said support frame on or into an extended elevator shaft and modifying some of said suspension components and modifying the parameters in a control system to adapt the operation of said drive to an extended travel distance of said passenger cabin or freight cage in said elevator shaft which has been extended.

27. A method as claimed in claim 25 wherein there is further provided the steps of constructing a building envelop below and about said permanent roof structure protected by a removable wall enclosure and using material handling means for displacing construction materials in a working space about said construction zone.

28. A method as claimed in claim 25 wherein there is further provided prior to step (viii) the steps of constructing said floor sub-assemblies on an uppermost floor of an operational occupational floor space in said construction zone; securing said floor sub-assemblies to said adjustable hoisting means.

29. A method as claimed in claim 25 wherein there is further provided the step of securing a removable wail enclosure about at least a portion of said construction zone.

30. A method as claimed in claim 29 wherein said permanent roof structure and said removable wall enclosure define a comfortable secured work space in said construction zone under said lifted permanent roof structure, said removable wall enclosure being a retractable wall enclosure extended about said further occupational floor space to create a protected construction zone and to shield same from inclement weather condition, said retractable wall enclosure being retractable in a top portion of said permanent roof structure.

31. A method as claimed in claim 25 wherein said occupational need arises upon the pre-sale of at least portions of a further occupational floor space and obtention of financing to construct said further occupational floor space, said permanent roof structure remaining on said multi-floor building when said building structure is completed.

32. A method as claimed in claim 30 wherein there is further provided the step of securing a rigid platform of said removable wall enclosure to attachment means on an exterior peripheral area of said sub-floor.

33. A method as claimed in claim 25 wherein after step (iv) there is provided the steps of installing temporary removable support means to temporarily support said lifted permanent roof structure at said predetermined distance, retracting at least some of said extensible load support means, effecting the construction of permanent load support columns and a further sub-floor supported by said permanent load support columns.

34. A method as claimed in claim 28 wherein said adjustable hoisting means are hingeably or detachably connected to said permanent roof structure and foldable or storable therein.

* * * * *